US006030736A

United States Patent [19]

Ikegami et al.

[11] Patent Number: 6,030,736

[45] Date of Patent: Feb. 29, 2000

[54] ELECTROPHOTOGRAPHIC PHOTOCONDUCTOR WITH POLYSILOXANE MIXTURE

[75] Inventors: Takaaki Ikegami, Susono; Yasuo Suzuki, Fuji; Hiroshi Nakai, Shizuoka-ken; Nozomu Tamoto, Numazu; Koji Kishida, Mitaka, all of Japan

[73] Assignee: Ricoh Company, Ltd., Tokyo, Japan

[21] Appl. No.: 09/050,200

[22] Filed: Mar. 30, 1998

[30] Foreign Application Priority Data

Mar. 28, 1997 [JP] Japan ..... 9-077988
Mar. 26, 1998 [JP] Japan ..... 10-078908

[51] Int. Cl.[7] ..... G03G 5/047; G03G 5/147

[52] U.S. Cl. ..... 430/59.6; 430/56; 430/67

[58] Field of Search ..... 430/56, 59.6, 67

[56] References Cited

U.S. PATENT DOCUMENTS 5,213,928 5/1993 Yu ..... 430/67
5,324,609 6/1994 Yagi et al. ..... 430/67
5,652,078 7/1997 Jalbert et al. ..... 430/67
5,702,855 12/1997 Ikegami et al. ..... 430/83

FOREIGN PATENT DOCUMENTS 61-51155 3/1986 Japan ..... 430/67
3-139656 6/1991 Japan ..... 430/67
1017165 1/1966 United Kingdom .
2 041 555 9/1980 United Kingdom .

*Primary Examiner*—Roland Martin
*Attorney, Agent, or Firm*—Oblon, Spivak, McClelland, Maier & Neustadt, P.C.

[57] ABSTRACT

An electrophotographic photoconductor is provided which includes a photoconductive layer formed overlying an electroconductive substrate, wherein the photoconductor includes in a top layer thereof a polysiloxane mixture selected from the group consisting of a polysiloxane mixture of an unmodified polysiloxane compound and a modified polysiloxane compound, a mixture of a methacryl modified polysiloxane compound and an alkyl modified polysiloxane compound, a mixture of a methacryl modified polysiloxane compound and a vinyl modified polysiloxane compound, and a mixture of an alkyl modified polysiloxane compound and a vinyl modified polysiloxane compound. The photoconductor has good durability.

16 Claims, 1 Drawing Sheet

ELECTROPHOTOGRAPHIC PHOTOCONDUCTOR WITH POLYSILOXANE MIXTURE

BACKGROUND OF THE INVENTION

1. Field of the Invention

The present invention relates to an electrophotographic photoconductor.

2. Discussion of the Background

Inorganic photoconductive materials such as selenium, amorphous silicon and zinc oxide have been used for an electrophotographic photoconductor because they have good sensitivity and durability. However, they have one or more drawbacks such as being toxic and having high manufacturing cost due to low productivity. Therefore, currently organic photoconductors have been developed which are atoxic and have potential of being able to be easily mass-manufactured at a relatively low manufacturing cost using a simple coating method.

These organic photoconductors have advantages such as being atoxic and having low manufacturing cost, however, they have drawbacks in point of sensitivity, stability in various environments and durability, and particularly photoconductors having good stability when used in various environments and good durability are strongly desired. In addition, particle size of toner becomes finer and finer because there are recently many demands such as color reproduction and high quality reproduction. Therefore, a need exists for a photoconductor having high toner transfer efficiency and good toner releasability (ability to release toner therefrom).

In attempting to improve these drawbacks, photoconductors which include a silicone resin or a silicone including polymer in a charge transporting layer which is formed on the surface thereof (Japanese Laid-Open Patent Publications No. 57-64243, 60-256146, 61-95358, 61-132954 and 61-219047). However, these photoconductors have drawbacks such as poor rub resistance and increase of residual surface potential causing fouling of background of recorded images when repeatedly used. In addition, a photoconductor which includes, in a charge transporting layer which is formed on the surface thereof, hydrodiene polysiloxane (Japanese Laid-Open Patent Publications No. 54-3534) or epoxy modified silicone and silicone having an active hydrogen (Japanese Laid-Open Patent Publications No. 5-158273) has been proposed, however, improvement in toner transfer efficiency and toner releasability is insufficient and further they have a drawback of increase of residual surface potential when repeatedly used. Thus, these conventional photoconductors which include a silicone including polymer and the like have poor durability and therefore they are desired to be improved.

Because of these reasons, a need exists for a photoconductor which has good durability without increase of residual surface potential when repeatedly used, and which further has high toner transfer efficiency and good toner releasability.

SUMMARY OF THE INVENTION

Accordingly, an object of the present invention is to provide a photoconductor which has good durability without increase of residual surface potential when repeatedly used, and which further has high toner transfer efficiency and good toner releasability.

Briefly this object and other objects of the present invention as hereinafter will become more readily apparent can be attained by a photoconductor which includes at least a photoconductive layer formed overlying an electroconductive substrate and which includes in a top layer thereof a polysiloxane mixture selected from the group consisting of a mixture of an unmodified polysiloxane compound and a modified polysiloxane compound, a mixture of a methacryl modified polysiloxane compound and an alkyl modified polysiloxane compound, a mixture of a methacryl modified polysiloxane compound and a vinyl modified polysiloxane compound, and a mixture of an alkyl modified polysiloxane compound and a vinyl modified polysiloxane compound.

The top layer preferably includes a binder resin which is a polycarbonate resin including the following repeating unit:

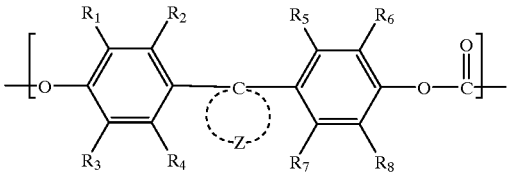

wherein Z represents nonmetal atoms which can form a carbon ring, a substituted carbon ring, a heterocyclic ring or a substituted heterocyclic ring; and R1, R2, R3, R4, R5, R6, R7 and R8 independently represent a hydrogen atom, a halogen atom, an aliphatic group, a substituted aliphatic group, a carbon ring, or a substituted carbon ring.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
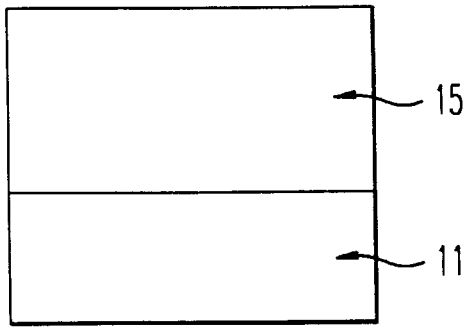
FIG. 1 is a cross section of an embodiment of single-layer type photoconductors of the present invention.
Figure 2:
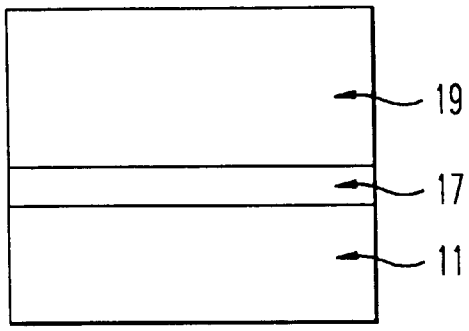
FIG. 2 is a cross section of an embodiment of multi-layer type photoconductors of the present invention.
Figure 3:
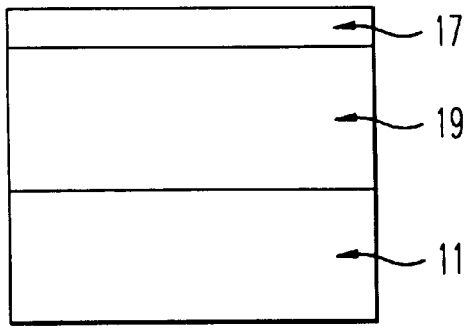
FIG. 3 is a cross section of another embodiment of multi-layer type photoconductors of the present invention.

FIG. 1 is a cross section illustrating a single-layer type photoconductor for use in the present invention. The photoconductor has a single-layer type photoconductive layer 15 which is formed on an electroconductive substrate 11 and which mainly includes a charge generating material and a charge transporting material. FIGS. 2 and 3 are cross sections illustrating multi-layer type photoconductors for use in the present invention. Each photoconductor has a charge generating layer 17 including a charge generating material and a charge transporting layer 19 including a charge transporting material which are overlaid to form a multi-layer type photoconductive layer.

In the present invention, a top layer of a photoconductor preferably includes a polysiloxane mixture selected from the group consisting of a mixture of an unmodified polysiloxane compound and a modified polysiloxane compound, a mixture of a methacryl modified polysiloxane compound and an alkyl modified polysiloxane compound, a mixture of a methacryl modified polysiloxane compound and a vinyl modified polysiloxane compound, and a mixture of an alkyl modified polysiloxane compound and a vinyl modified polysiloxane compound. The top layer means the photoconductive layer 15 in the photoconductor illustrated FIG. 1, the charge transporting layer 19 in the photoconductor illustrated in FIG. 2 and the charge generating layer 17 in the photoconductor illustrated in FIG. 3. In the present invention, a layer such as an insulating layer and a protective layer can be formed on the surface of a photoconductor, and in this case the insulating layer or the protective layer is the top layer. The polysiloxane mixture can be included in a top layer by coating a coating liquid including the polysiloxane mixture and drying the coated liquid. If a large amount of polysiloxane mixture is added in the top layer coating liquid to produce better effects, the polysiloxane mixture is preferably dissolved or dispersed in a solvent of the coating liquid. In addition, if desired, the coating liquid may be dispersed in a paint shaker, a sand mill, a bead mill or a ball mill.

Each polysiloxane compound in the above-mentioned polysiloxane mixtures for use in the present invention is considered to be able to improve to some extent the properties such as toner transfer efficiency and toner releasability and to reduce surface energy of the photoconductor by itself, however, these properties are dramatically improved when they are mixed because of a synergistic effect thereof. In particular when a mixture of a dimethyl polysiloxane compound having formula (1) which is shown below and a methacryl modified polysiloxane compound having formula (3) which is also shown below is included in a photoconductor, the photoconductor has excellent durability without increase of residual surface potential when repeatedly used and excellent toner transfer efficiency and toner releasability.

Unmodified polysiloxanes compounds include dimethyl polysiloxane, diphenyl polysiloxane, and methylphenyl polysiloxane.

Suitable dimethyl polysiloxane and diphenyl polysiloxane compounds for use in the present invention include compounds which have the following formula (1) and which may have a ring structure:

(1)

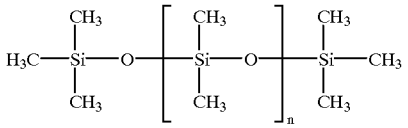

wherein n is a positive integer.

Suitable methylphenyl polysiloxane and diphenyl polysiloxane compounds for use in the present invention include compounds which have the following formula (2) and which may have a ring structure:

(2)

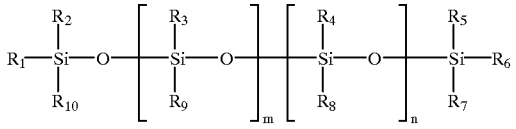

wherein R1–R10 independently represent a methyl group or a phenyl group which may be substituted, and at least one of them is a phenyl group which may be substituted; and m and n are independently 0 or a positive integer, and at least one of them is not 0.

Modified polysiloxane compounds include methacryl modified, alkyl modified and vinyl modified polysiloxane.

Suitable methacryl modified polysiloxane compounds for use in the present invention include compounds having the following formula (3) and may have a ring structure:

(3)

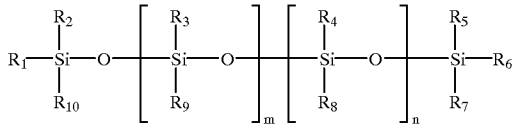

wherein R1–R10 independently represent an alkyl group having carbon atoms of from 1 to 3 an alkoxy group having carbon atoms of from 1 to 3,—R11—$C(CH_3)$═$CH_2$ or —R12—OCO—$C(CH_3)$═$CH_2$, and at least one of them is —R11—$C(CH_3)$═$CH_2$ or —R12—OCO—$C(CH_3)$═$CH_2$, wherein R11 and R12 independently represent an alkylene group; and m and n are independently 0 or a positive integer, and at least one of them is not 0.

Suitable alkyl modified polysiloxane compounds for use in the present invention include compounds which have the following formula (4) and which may have a ring structure:

(4)

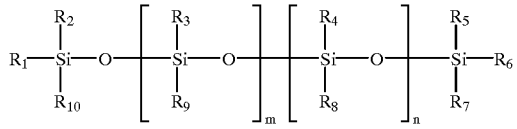

wherein R1–R10 independently represent an alkyl group having carbon atoms of from 1 to 30 an alkoxy group having carbon atoms of from 1 to 3 or an aralkyl group, and at least one of them is alkyl group having carbon atoms of from 4 to 30 or an aralkyl group; and m and n are independently 0 or a positive integer, and at least one of them is not 0.

Suitable vinyl modified polysiloxane compounds for use in the present invention include compounds which have the following formula (5) and which may have a ring structure:

(5)

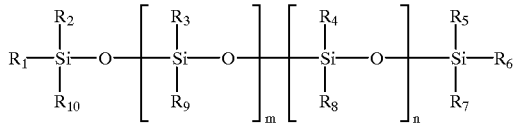

wherein R1–R10 independently represent an alkyl group having carbon atoms of from 1 to 3, an alkoxy group having carbon atoms of from 1 to 3, a phenyl group which may be substituted or —CH═$CH_2$, and at least one of them is —CH═$CH_2$; and m and n are independently 0 or a positive integer, and at least one of them is not 0.

In addition, the modified polysiloxane compounds include methyl hydrodiene polysiloxane, amino modified polysiloxane, epoxy modified polysiloxane, carboxy modified polysiloxane, carbinol modified polysiloxane, mercapto modified polysiloxane, phenol modified polysiloxane, polyether modified polysiloxane, fatty acid ester modified polysiloxane, alkoxy modified polysiloxane, hetero functional group modified polysiloxane and fluorine containing polysiloxane.

Specific examples of the methyl hydrodiene polysiloxane compounds include compounds which have the following formula (6) and which may have a ring structure:

(6)

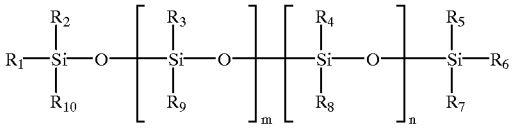

wherein R1–R10 independently represent a hydrogen atom or a methyl group, and at least one of them is a hydrogen atom; and m and n are independently 0 or a positive integer, and at least one of them is not 0.

Specific examples of the amino modified polysiloxane compounds include compounds which have the following formula (7) and which may have a ring structure:

(7)

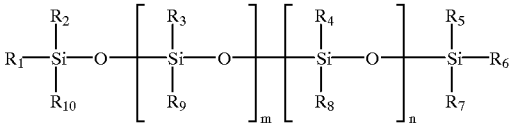

wherein R1–R10 independently represent an alkyl group having carbon atoms of from 1 to 3, —R11—NH—R12$NH_2$ or —R13—$NH_2$, and at least one of them is —R11—NH—R12$NH_2$ or —R13—$NH_2$, wherein R11–R13 independently represent an alkyl group; and m and n are independently 0 or a positive integer, and at least one of them is not 0.

Specific examples of the epoxy modified polysiloxane compounds include compounds which have the following formula (8) and which may have a ring structure:

(8)

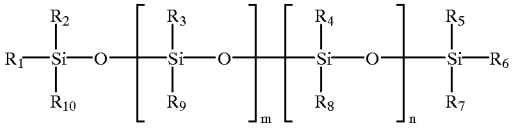

wherein R1–R10 independently represent an alkyl group having carbon atoms of from 1 to 3,

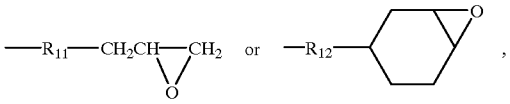

and at least one of them is

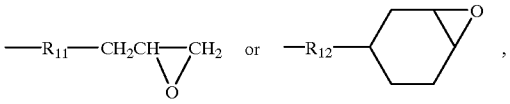

wherein R11–R12 independently represent an alkyl group; and m and n are independently 0 or a positive integer, and at least one of them is not 0.

Specific examples of the carboxy modified polysiloxane compounds include compounds which have the following formula (9) and which may have a ring structure:

(9)

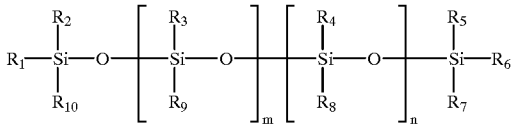

wherein R1–R10 independently represent an alkyl group having carbon atoms of from 1 to 3, an alkoxy group having carbon atoms of from 1 to 3 or —R11—COOH, and at least one of them is —R1—COOH, wherein R11 represents an alkyl group; and m and n are independently 0 or a positive integer, and at least one of them is not 0.

Specific examples of the carbinol modified polysiloxane compounds include compounds which have the following formula (10) and which may have a ring structure:

(10)

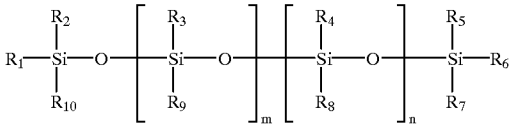

wherein R1–R10 independently represent an alkyl group having carbon atoms of from 1 to 3, an alkoxy group having carbon atoms of from 1 to 3 or —R11—OH, and at least one of them is —R11—COOH, wherein R11 represents an alkyl group; and m and n are independently 0 or a positive integer, and at least one of them is not 0.

Specific examples of the mercapto modified polysiloxane compounds include compounds which have the following formula (11) and which may have a ring structure:

(11)

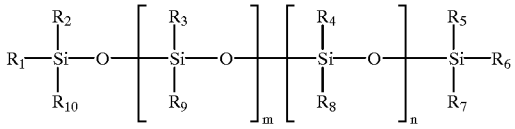

wherein R1–R10 independently represent an alkyl group having carbon atoms of from 1 to 3, an alkoxy group having carbon atoms of from 1 to 3 or —R11—SH, and at least one of them is —R11—SH, wherein R11 represents an alkyl group; and m and n are independently 0 or a positive integer, and at least one of them is not 0.

Specific examples of the phenol modified polysiloxane compounds include compounds which have the following formula (12) and which may have a ring structure:

(12)

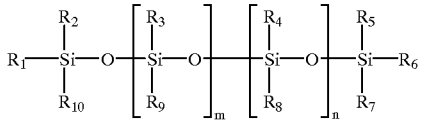

wherein R1–R10 independently represent an alkyl group having carbon atoms of from 1 to 3, an alkoxy group having carbon atoms of from 1 to 3 or

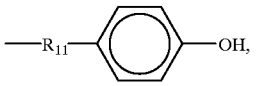

and at least one of them is

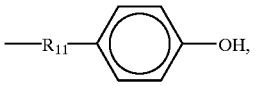

wherein R11 represents an alkyl group; and m and n are independently 0 or a positive integer, and at least one of them is not 0.

Specific examples of the polyether modified polysiloxane compounds include compounds which have the following formula (13) and which may have a ring structure:

(13)

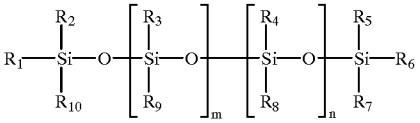

wherein R1–R10 independently represent an alkyl group having carbon atoms of from 1 to 3 or —R11—$(C_2H_4O)a(C_3H_6O)b$—R12, and at least one of them is —R11—$(C_2H_4O)a(C_3H_6O)b$—R12, wherein R11 represents an alkyl group and R12 represents an alkyl group, a hydroxy group or —R13—OH, and wherein R13 represents an alkyl group; and m, n, a and b are independently 0 or a positive integer, and at least one of m and n is not 0 and at least one of a and b is not 0.

Specific examples of the fatty acid ester modified polysiloxane compounds include compounds which have the following formula (14) and which may have a ring structure:

(14)

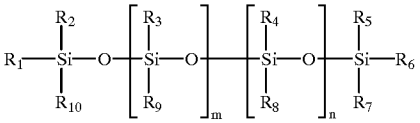

wherein R1–R10 independently represent an alkyl group having carbon atoms of from 1 to 3, an alkoxy group having carbon atoms of from 1 to 3 or —OCO—R11, and at least one of them is —OCO—R11, wherein R11 represents an alkyl group; and m and n are independently 0 or a positive integer, and at least one of them is not 0.

Specific examples of the alkoxy modified polysiloxane compounds include compounds which have the following formula (15) and which may have a ring structure:

(15)

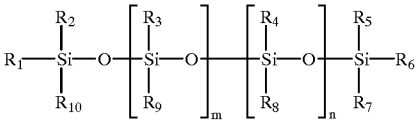

wherein R1–R10 independently represent an alkyl group having carbon atoms of from 1 to 3 or an alkoxy group having carbon atoms of from 1 to 30, and at least one of them is an alkoxy group having carbon atoms of from 4 to 30; and m and n are independently 0 or a positive integer, and at least one of them is not 0.

Specific examples of the hetero functional group modified polysiloxane compounds include compounds which have the following formula (16) and which may have a ring structure:

(16)

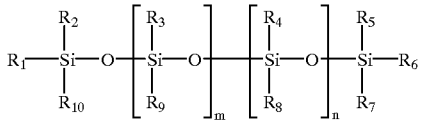

wherein R1–R10 independently represent an alkyl group having carbon atoms of from 1 to 3, an alkoxy group having carbon atoms of from 1 to 3, an amino group, an epoxy group or a polyether group, and at least two of them are independently a functional group selected from the group consisting of an alkoxy group having carbon atoms of from 1 to 3, an amino group, an epoxy group and a polyether group; and m and n are independently 0 or a positive integer, and at least one of them is not 0.

Specific examples of the fluorine containing polysiloxane compounds include compounds which have the following formula (17) and which may have a ring structure:

(17)

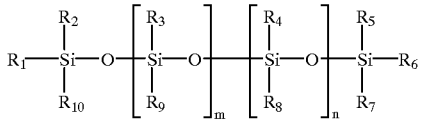

wherein R1–R10 independently represent an alkyl group having carbon atoms of from 1 to 3, an alkoxy group having carbon atoms of from 1 to 3 or —R11—$CF_3$, and at least one of them is —R11—$CF_3$, wherein R11 represents an alkyl group; and m and n are independently 0 or a positive integer, and at least one of them is not 0.

The addition quantity of the polysiloxane mixture is preferably from about 0.5 to about 10% by weight of the total quantity of binder resins in the top layer to maintain high toner transfer efficiency, good toner releasability and good image qualities without fouling and the like. The mixing ratio of one of the polysiloxane compounds to the other thereof in the polysiloxane mixture is from about 5/95 to about 95/5 by weight.

The polysiloxane compounds for use in the present invention preferably have viscosity, which corresponds to the molecular weight or the polymerization degree thereof, greater than about 100 cSt at 25° C. The higher the viscosity of polysiloxane compounds included in a photoconductor, the better durability the photoconductor has, and when at least one polysiloxane compound included in the polysiloxane mixture has viscosity greater than about 100 cSt at 25° C., the durability of the photoconductor is satisfactory.

Suitable materials for use as the electroconductive substrate 11 include electroconductive materials having volume resistivity less than about $10^{10}$ Ω·cm. Specific examples of such materials include films or cylinders of plastics or paper whose surfaces are coated with a material, for example, metals such as aluminum, nickel, chrome, nickel-chrome alloys, copper, silver, gold or platinum, or metal oxides such as tin oxide or indium oxide by a vacuum evaporation method or a sputtering method. In addition, plates or cylinders which are made of metals such as aluminum, aluminum alloys, nickel or stainless steel whose surfaces may be subjected to treatment such as cutting, super finishing or polishing can be also used.

Next, the photoconductive layer is described hereinafter. The photoconductive layer may be a single-layer type or a multi-layer type. At first, a multi-layer type photoconductive layer which includes a charge generating layer 17 and a charge transporting layer 19 is described.

The charge generating layer 17 is a layer which mainly includes a charge generating material.

Suitable charge generating materials include organic materials such as monoazo dyes, disazo dyes, trisazo dyes, perylene dyes, perynone dyes, quinacridone dyes, quinone type condensation polycyclic compounds, squaric acid dyes, phthalocyanine dyes, naphthalocyanine dyes and azulenium salt dyes, or inorganic materials such as selenium, selenium-tellurium alloys, selenium-arsenic alloys and amorphous silicon. These charge generating materials are employed alone or in combination.

The charge generating layer 17 can be formed by coating a coating liquid in which one or more charge generating materials are dispersed, if desired together with a binder resin, in a proper solvent such as tetrahydrofuran, cyclohexanone, dioxane, 2-butanone or dichloroethane using a ball mill, an attritor or a sand mill, and then drying the coated liquid. The coating can be performed by a dip coating, a spray coating, a bead coating method or the like. Suitable binder resins for use in the charge generating layer 17 include polyamide resins, polyurethane resins, polyester resins, epoxy resins, poly ketone resins, polycarbonate resins, silicone resins, acrylic resins, polyvinyl butyral resins, polyvinyl formal resins, polyvinyl ketone resins, polystyrene resins, polyacryl amide resins and the like. When the charge generating layer 17 is the top layer as illustrated in FIG. 3, polycarbonate resins including a repeating unit having the following formula (18) are preferably used in the charge generating layer 17 because they have good compatibility with the above-mentioned polysiloxane compounds and thereby the charge generating layer 17 can be easily manufactured.

(18)

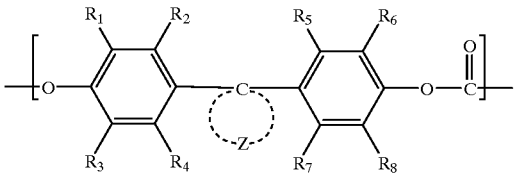

wherein Z represents nonmetal atoms which can form a carbon ring or a heterocyclic ring each of which may be substituted: and R1 to R8 independently represent a hydrogen atom, a halogen atom, or an aliphatic group or a carbon ring group each of which may be substituted.

The content of the binder resin in the charge generating layer 17 is preferably 0 to about 2 parts by weight per 1 part by weight of the charge generating material. When the charge generating layer 17 is not a top layer of a photoconductor, the charge generating layer 17 can be formed by a known vacuum evaporation method. The thickness of the charge generating layer 17 is preferably from about 0.01 to about 5 $\mu$m, and more preferably from about 0.1 to about 2 $\mu$m.

The charge transporting layer 19 can be formed by coating a coating liquid in which one or more charge transporting materials and a binder resin are dissolved or dispersed in a proper solvent, and then drying the coated liquid. In addition, additives such as a plasticizer and the like can be included in the charge transporting layer 19, if desired.

Suitable charge transporting materials include materials having the formulas which are described below. These charge transporting materials are employed alone or in combination.

Specific examples of such charge transporting materials include oxazole derivatives, imidazole derivatives, triphenyl amine derivatives and compounds having the following formulas of from (19) to (37).

(19)

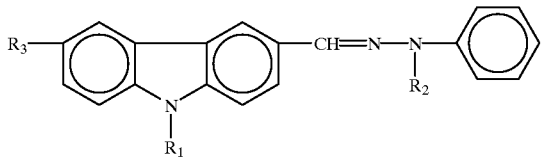

wherein R1 represents a methyl group, an ethyl group, a 2-hydroxyethyl group or a 2-chloroethyl group; R2 represents a methyl group, an ethyl group, a benzyl group or a phenyl group; and R3 represents a hydrogen atom, a bromine atom, an alkyl group having carbon atoms of from 1 to 4, an alkoxy group having carbon atoms of from 1 to 4, a dialkylamino group or a nitro group.

Specific examples of such compounds having formula (19) include 9-ethylcarbazole-3-aldehyde-1-methyl-1-phenylhydrazone; 9-ethylcarbazole-3-aldehyde-1-benzyl-1-phenylhydrazone; 9-ethylcarbazole-3-aldehyde-1,1-diphenylhydrazone; and the like.

(20)

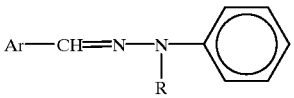

wherein Ar represents a naphthalene group, an anthracene group or a styryl group each of which may be substituted, or a pyridine ring, a furan ring or a thiophene ring; and R represents an alkyl group or a benzyl group.

Specific examples of such compounds having formula (20) include 4-diethylaminostyryl-β-aldehyde-1-methyl-1-phenylhydrazone; 4-methoxynaphthalene-1-aldehyde-1-benzyl-1-phenylhydrazone; and the like.

(21)

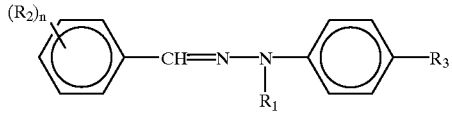

wherein R1 represents an alkyl group, a benzyl group, a phenyl group or a naphthyl group; R2 represents a hydrogen atom, an alkyl group having carbon atoms of from 1 to 3, an alkoxy group having carbon atoms of from 1 to 3, a dialkylamino group, a diaralkylamino group or a diarylamino group; n is an integer of from 1 to 4, and when n is 2 or more, each of R2 may be the same or different from each other; and R3 represents a hydrogen atom or a methoxy group.

Specific examples of such compounds having formula (21) include 4-methoxybenzaldehyde-1-methyl-1-phenylhydrazone; 2.4-dimethoxybenzaldehyde-1-benyl-1phenylhydrazone; 4-diethylaminobenzaldehyde-1,1-diphenylhydrazone; 4-methoxybenzaldehyde-1-benzyl-1-(4-methoxy)phenylhydrazone; 4-diphenylaminobenzaldehyde-1-benzyl-1-phenylhydrazone; 4-dibenzylaminobenzaldehyde-1,1-diphenylhydrazone; and the like.

(22)

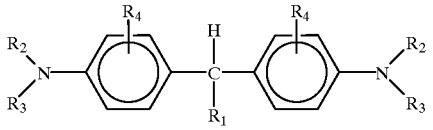

wherein R1 represents an alkyl group having carbon atoms of from 1 to 11, a phenyl group which may be substituted, or a heterocyclic ring group; R2 and R3 independently represent a hydrogen atom, an alkyl group having carbon atoms of form 1 to 4, a hydroxyalkyl group, a chloroalkyl group or an aralkyl group which may be substituted, and R2 and R3 may combine with each other to form a heterocyclic ring including a nitrogen atom; and each of R4 independently represents a hydrogen atom, an alkyl group having carbon atoms of form 1 to 4, an alkoxy group or a halogen atom.

Specific examples of such compounds having formula (22) include 1,1-bis(4-dibenzylaminophenyl)propane; tris(4-diethylaminophenyl)methane; 1,1-bis(4-dibenzylaminophenyl)propane; 2,2'-dimethyl-4,4'-bis(diethylamino)-triphenylmethane; and the like.

(23)

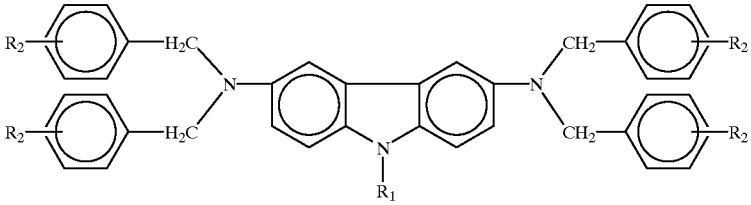

wherein R1 represents a hydrogen atom, an alkyl group which may be substituted, or a phenyl group; and R2 represents a hydrogen atom, an alkyl group which may be substituted, an alkoxy group or a halogen atom.

Specific examples of such compounds having formula (23) include N-ethyl-3,6-tetrabenzylaminocarbazole and the like.

(24)

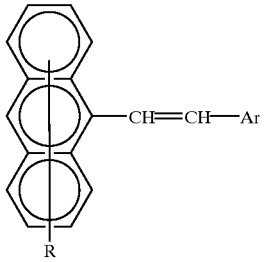

wherein R represents a hydrogen atom or a halogen atom; and Ar represents a phenyl group which may be substituted a naphthyl group, an anthryl group or a carbazolyl group.

Specific examples of such compounds having formula (24) include 9-(4-diethylaminostyryl)anthracenc; 9-bromo-10-(4-4-diethylaminostyryl)anthracene; and the like.

(25)

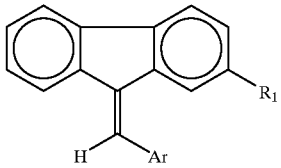

wherein R1 represents a hydrogen atom, a halogen atom, a cyano group, an alkoxy group having carbon atoms of from 1 to 4 or an alkyl group having carbon atoms of from 1 to 4; Ar represents

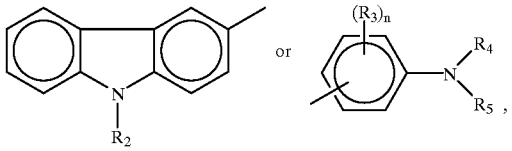

wherein R2 represents an alkyl group having carbon atoms of from 1 to 4; R3 represents a hydrogen atom, a halogen atom, an alkyl group having carbon atoms of from 1 to 4, an alkoxy group having carbon atoms of from 1 to 4 or a dialkylamino group; n is 1 or 2, and when n is 2, each of R3 may be the same or different from each other; and R4 and R5 independently represent a hydrogen atom, an alkyl group having carbon atoms of form 1 to 4 which may be substituted, or a benzyl group which may be substituted.

Specific examples of such compounds having formula (25) include 9-(4-dimethylaminobenzylidene)fluorene; 3-(9-fluorenylidene)-9-ethylcarbazole; and the like.

(26)

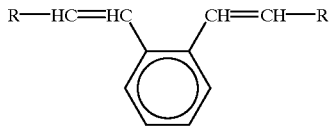

wherein R represents a carbazolyl group, a pyridyl group, a thienyl group, an indolyl group, a furyl group, or a phenyl group, a styryl group, a naphthyl group or an anthryl group each of which may be substituted with one or more substituent groups selected from the group consisting of a dialkylamino group, an alkyl group, an alkoxy group, an carboxy group or an ester thereof, a halogen atom, a cyano group, an aralkylamino group, an N-alkyl-N-aralkylamino group, an amino group, a nitro group, or an acetylamino group.

Specific examples of such compounds having formula (26) include 1,2-bis(4-diethylaminostyryl)benzene; 1,2-bis (2,4-dimethoxystyryl)benzene; and the like.

(27)

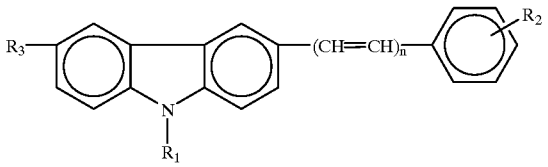

wherein R1 represents a lower alkyl group, a phenyl group which may be substituted, or a benzyl group; R2 and R3 independently represent a hydrogen atom, a lower alkyl group, a lower alkoxy group, a halogen atom, a nitro group, an amino group, or an amino group which is substituted with a lower alkyl group or a benzyl group; and n is 1 or 2.

Specific examples of such compounds having formula (27) include 3-styryl-9-ethylcarbazole; 3-(4-methoxystyryl)-9-ethylcarbazole; and the like.

(28)

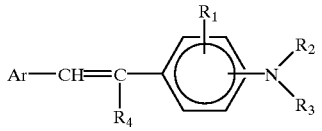

wherein R1 represents a hydrogen atom, an alkyl group, an alkoxy group or a halogen atom; R2 and R3 independently represent an alkyl group, an aralkyl group which may be substituted or an aryl group which may be substituted; R4 represents a hydrogen atom, a lower alkyl group or a phenyl group which may be substituted; and Ar represents a phenyl group which may be substituted or a naphthyl group.

Specific examples of such compounds having formula (28) include 4-diphenylaminostilbene; 4-dibenzylaminostilbene; 4-ditolylaminostilbene; 1-(4-diphenylaminostyryl)naphthalene; 1-(4-diethylaminostyryl) naphthalene; and the like.

(29)

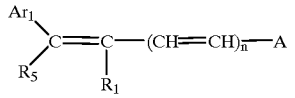

wherein n is 0 or 1; R1 represents a hydrogen atom, an alkyl group, or a phenyl group which may be substituted; Ar1 represents an aryl group which may be substituted: R5 represents an alkyl group which may be substituted or an aryl group which may be substituted, and A represents

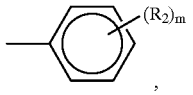

,

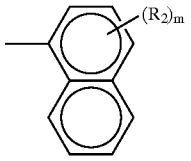

, 9-anthryl group, or a carbazolyl group which may be substituted, wherein R2 represents a hydrogen atom, an alkyl group, an alkoxy group, a halogen atom or

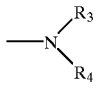

, wherein R3 and R4 independently represent an alkyl group, an aralkyl group which may be substituted, or an aryl group which may be substituted, and R4 may form a ring; and m is 0, 1, 2, or 3, and when m is 2 or more, each of R2 may be the same or different from each other, and when n is 0, A and R1 may combine with each other to form a ring.

Specific examples of such compounds having formula (29) include 4'-diphenylamino-α-phenylstilbene; 4'-bis(4-methylphenyl)amino-α-phenylstilbene; and the like.

(30)

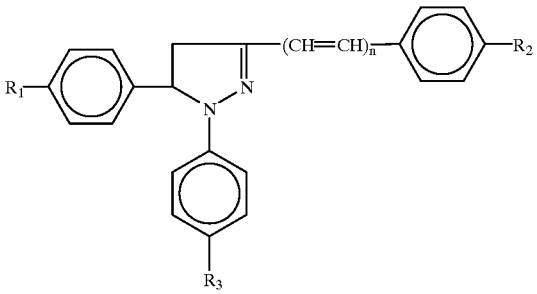

wherein R1, R2 and R3 independently represent a hydrogen atom, a lower alkyl group, a lower alkoxy group, a dialkylamino group or a halogen atom; and n is 0 or 1.

Specific examples of such compounds having formula (30) include 1-phenyl-3-(4-diethylaminostyryl)-5-(4-diethylaminophenyl0pyrazoline; 1-phenyl-3-(4-dimethylaminostyryl)-5-(4-dimethylaminophenyl) pyrazoline; and the like.

(31)

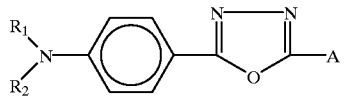

wherein R1 and R2 independently represent an alkyl group which may be substituted, or an aryl group which may be substituted; and A represents a substituted amino group, an aryl group which may be substituted, or an allyl group.

Specific examples of such compounds having formula (31) include 2, 5-bis(4-diethylaminophenyl)-1,3,4-oxadiazole; 2-N,N-diphenylamino-5-(4-diethylaminophenyl)-1,3,4-oxadiazole; 2-(4-dimethylaminophenyl)-5-(4-diethylaminophenyl)-1,3,4-oxadiazole; and the like.

(32)

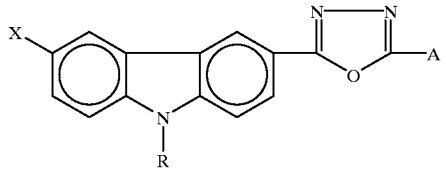

wherein X represents a hydrogen atom, a lower alkyl group or a halogen atom; R represents an alkyl group which may be substituted or an aryl group which may be substituted; and A represents a substituted amino group or an aryl group which may be substituted.

Specific examples of such compounds having formula (32) include 2-N,N-diphenylamino-5-(N-ethylcarbazole-3-yl)-1,3,4-oxadiazole; 2-(4-diethylaminophenyl)-5-(N-ethylcarbazole-3-yl)-1,3,4-oxadiazole; and the like.

(33)

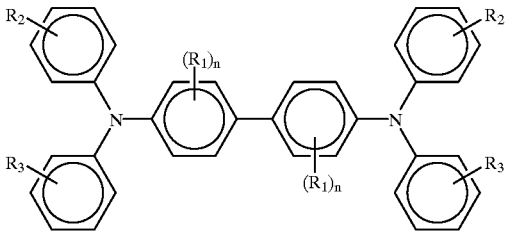

wherein R1 represents a lower alkyl group, a lower alkoxy group or a halogen atom; n is 0 or an integer of from 1 to 4; and R2 and R3 independently represent a hydrogen atom, a lower alkyl group, a lower alkoxy group or a halogen atom.

Specific examples of such benzidine compounds having formula (33) include N,N'-diphenyl-N,N '-bis(3-methylphenyl)-{1,1'-biphenyl}-4,4'-diamine; 3,3'-dimethyl-N,N,N', N'-tetrakis(4-methylphenyl)-{1,1'-biphenyl}-4,4'-diamine; and the like.

(34)

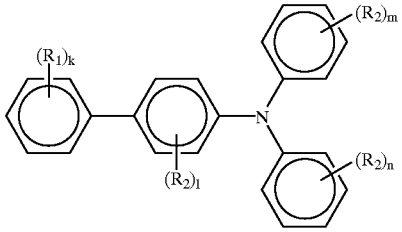

wherein R1, R3 and R4 independently represent a hydrogen atom, an amino group, an alkoxy group, a thioalkoxy group, an aryloxy group, a methylenedioxy group, an alkyl group which may be substituted, a halogen atom or an aryl group which may be substituted; R2 represents a hydrogen atom, an alkoxy group, an alkyl group which may be substituted, or a halogen atom, and at least one of R1, R2, R3 and R4 is not a hydrogen atom; and k, 1, m and n are independently an integer of from 1 to 4, and when each of k, 1, m and n is 2 or more, each of R1, R2, R3 and R4 may be the same or different from each other.

Specific examples of such biphenyl amine compounds having formula (34) include 4'-methoxy-N,N-diphenyl-{1,1'-biphenyl}-4-amine; 4'-methyl-N,N'-bis(4-methylphenyl)-{1,1'-biphenyl}-4-amine; 4'-methoxy-N,N'-bis(4-methylphenyl)-{1,1'-biphenyl}-4-amine; and the like.

(35)

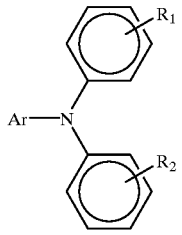

wherein Ar represents a condensation polycyclic hydrocarbon group having carbon atoms less than or equal to 18; and R1 and R2 independently represent a hydrogen atom, a halogen atom, an alkyl group which may be substituted, an alkoxy group or a phenyl group which may be substituted.

Specific examples of such triarylamine compounds having formula (35) include 1-phenylaminopyrene; 1-di(p-tolylamino)pyrene; and the like.

A—CH=CH—Ar—CH=CH—A (36)

wherein Ar represents an aromatic hydrocarbon group which may be substituted; and A represents

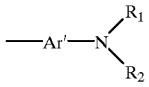

wherein Ar' represents an aromatic hydrocarbon group which may be substituted, and R1 and R2 independently represent an alkyl group which may be substituted, or an aryl group which may be substituted.

Specific examples of such diolefin aromatic compounds having formula (36) include 1,4-bis(4-diphenylaminostyryl) benzene; 1,4-bis{4-di(p-tolyl)aminostyryl}benzene; and the like.

(37)

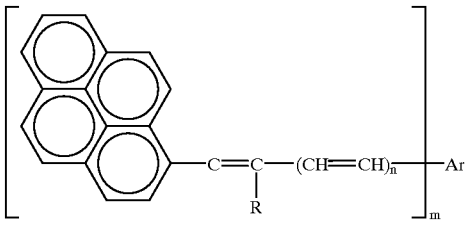

wherein Ar represents an aromatic hydrocarbon group; R represents a hydrogen atom, an alkyl group which may be substituted, or an aryl group; and n is 0 or 1, and m is 1 or 2, and when n is 0 and m is 1, Ar and R may combine with each other to form a ring.

Specific examples of such styrylpyrene compounds having formula (37) include 1-(4-diphenylaminostyryl)pyrene; 1-{4-di(p-tolyl)aminostyryl}pyrene; and the like.

Suitable binder resins which can be used in the charge transporting layer 19 together with a charge transporting material include thermoplastic resins and thermosetting resins such as polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride, polyarylate resins, phenoxy resins, polycarbonate resins, cellulose acetate resins, ethyl cellulose resins, polyvinyl butyral resins, polyvinyl formal resins, polyvinyl toluene resins, acrylic resins, silicone resins, epoxy resins, melamine resins, urethane resins, phenolic resins alkyd resins and the like. Among these resins, polycarbonate resins are preferable because photoconductors including them can be used in various environmental conditions and the photoconductors have good rubbing resistance and mechanical resistance. Particularly, polycarbonate resins including a main repeating unit having the following formula (18) are more preferable since they have good productivity because of having good compatibility with polysiloxane compounds mentioned above.

(18)

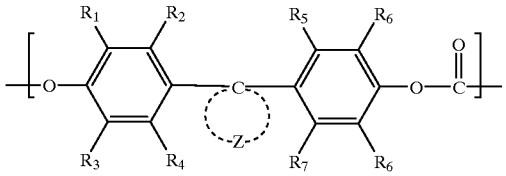

wherein Z represents nonmetal atoms which can form a carbon ring or a heterocyclic ring each of which may be substituted; and R1 to R8 independently represent a hydrogen atom, a halogen atom, or an aliphatic group or a carbon ring group each of which may be substituted.

These polycarbonate resins are on the market, and specific examples of such resins include lupilon Z-200 manufactured by Mitsubishi Gas Chemical Co,. Ltd.

Suitable solvents for use in a coating liquid for forming the charge transporting layer 19 include tetrahydrofuran, dioxane, toluene, 2-butanone, monochlorobenzene, dichloroethane, methylene chloride and the like.

The thickness of the charge transporting layer 19 is preferably from about 5 to about 100 $\mu$m.

The charge transporting layer 19 may include a plasticizer. Suitable plasticizers for use in the charge transporting layer 19 include known plasticizers, which are conventionally used as plasticizers for common resins, such as dibutyl phthalate, dioctyl phthalate and the like. Suitable content of the plasticizer in the charge transporting layer 19 is from 0 to about 30% by weight of the binder resin.

Next, a single-layer type photoconductive layer 15 is described hereinafter. This photoconductive layer 15 is typically a functionally-separated type photoconductive layer which includes a charge generating material and a charge transporting material. Namely, the photoconductive layer 15 can be formed by coating a coating liquid which includes a charge generating material and a charge transporting material which are dissolved or dispersed in a solvent together with a binder resin, and then drying the coated liquid. Additives such as a plasticizer may be included therein, if desired.

Suitable binder resins for use in the photoconductive layer 15 include resins for use in the charge transporting layer 19 and the photoconductive layer 15 may include resins for use in the charge generating layer 17.

The thickness of the single-layer type photoconductor is preferably from about 5 to about 100 $\mu$m.

The photoconductors of the present invention may include an under-coat layer between the electroconductive substrate 11 and the photoconductive layer. The under-coat layer mainly includes a resin. Since a photoconductive layer is typically formed on the under-coat layer by coating a liquid including an organic solvent, the resin in the under-coat layer preferably has good resistance to organic solvents. Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like.

The under-coat layer may include a fine powder of metal oxide such as titanium oxide, silica, alumina, zirconium oxide, tin oxide and indium oxide to prevent recorded images from generating moire and to decrease residual surface potential of the photoconductor. The under-coat layer can be also formed using a proper solvent and a proper coating method as mentioned in the photoconductive layer.

A metal oxide layer which is formed, for example, by a sol-gel method using a silane coupling agent, titanium coupling agent or a chromium coupling agent can be also used as an under-coat layer.

A layer of aluminum oxide which is formed by an anodic oxidation method and a layer of an organic compound such as polyparaxylylene or an inorganic compound such as SiO, $SnO_2$, $TiO_2$, ITO or $CeO_2$ which is formed by a vacuum evaporation method arc also preferably used as an under-coat layer. The thickness of the under-coat layer is preferably 0 to about 5 $\mu$m.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Each of an under-coat layer coating liquid, a charge generating layer coating liquid and a charge transporting layer coating liquid each of whose formulation is as follows was coated on an aluminum cylinder having an outside diameter of 100 mm and dried one by one so that an under-coat layer 3 μm thick, a charge generating layer 0.2 μm thick and a charge transporting layer 28 μm thick were overlaid on the aluminum cylinder. Thus a photoconductor of the present invention was obtained.

| Formulation of under-coat layer coating liquid | |
|---|---|
| Oil-free alkyd resin (Bekkolite M6401, manufactured by Dainippon Ink and Chemicals Inc.) | 15 |
| Melamine resin (Super Bekkamin G-821, manufactured by Dainippon Ink and Chemicals Inc.) | 10 |
| Titanium dioxide (Tipaque R-670, manufactured by Ishihara Sangyo Kaisha Ltd.) | 50 |
| 2-butanone | 40 |
| **Formulation of charge generating layer coating liquid** | |
| Charge generating material having the following formula (38) | 5 |

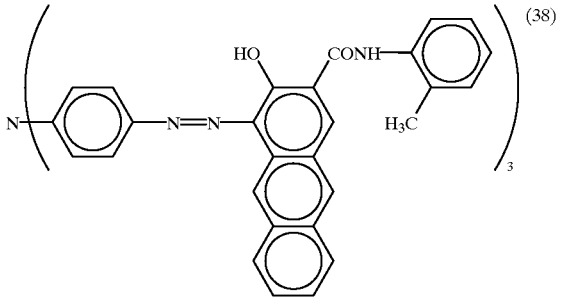

(38)

| | |
|---|---|
| Polyvinyl butyral (Denka Butyral #5000A, manufactured by Denki Kagaku Kogyo K.K.) | 5 |
| Cyclohexanone | 350 |
| **Formulation of charge transporting layer coating liquid** | |
| Dimethyl polysiloxane (KF96 manufactured by Shin-Etsu Silicone Co., Ltd. whose viscosity was 300 cSt) | 0.25 |
| Methacryl modified polysiloxane (X-22-164B manufactured by Shin-Etsu Silicone Co., Ltd whose viscosity was 54 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 2

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Dimethyl polysiloxane (KF96, manufactured by Shin-Etsu silicone Co., Ltd. whose viscosity was 300 cSt) | 0.01 |
| Methacryl modified polysiloxane (X-22-164B, manufactured by Shin-Etsu Silicone Co., Ltd. whose viscosity was 54 cSt) | 0.01 |

-continued

| Formulation of charge transporting layer coating liquid | |
|---|---|
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 3

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Dimethyl polysiloxane (KF96, manufactured by Shin-Etsu silicone Co., Ltd. whose viscosity was 300 cSt) | 0.025 |
| Methacryl modified polysiloxane (X-22-164B, manufactured by Shin-Etsu Silicone Co., Ltd. whose viscosity was 54 cSt) | 0.025 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 4

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Dimethyl polysiloxane (KF96, manufactured by Shin-Etsu silicone Co., Ltd. whose viscosity was 300 cSt) | 0.5 |
| Methacryl modified polysiloxane (X-22-164B, manufactured by Shin-Etsu Silicone Co., Ltd. whose viscosity was 54 cSt) | 0.5 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 5

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Dimethyl polysiloxane (KF96, manufactured by Shin-Etsu silicone Co., Ltd. whose viscosity was 300 cSt) | 0.75 |
| Methacryl modified polysiloxane (X-22-164B, manufactured by Shin-Etsu Silicone Co., Ltd. whose viscosity was 54 cSt) | 0.75 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 6

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Dimethyl polysiloxane (KF96, manufactured by Shin-Etsu silicone Co., Ltd. whose viscosity was 50 cSt) | 0.25 |
| Methacryl modified polysiloxane (X-22-164B, manufactured by Shin-Etsu Silicone Co., Ltd. whose viscosity was 54 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 7

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Dimethyl polysiloxane (KF96, manufactured by Shin-Etsu Silicone Co., Ltd. whose viscosity was 50 cSt) | 0.25 |
| Methacryl modified polysiloxane (FM0725, manufactured by ChissoCo.Ltd. whose viscosity was 200 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 8

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Dimethyl polysiloxane (KF96, manufactured by Shin-Etsu Silicone Co., Ltd. whose viscosity was 100 cSt) | 0.25 |
| Methacryl modified polysiloxane (X-22-164C, manufactured by Shin-Etsu Silicone Co., Ltd. whose viscosity was 94 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 9

The procedure for preparation of the photoconductor in Example 1 was repeated to obtain a photoconductor of the present invention except that the polycarbonate resin in the charge transporting layer coating liquid was replaced with 10 parts of a polycarbonate resin. Panlite K-1300, which was manufactured by Teijin Chemicals Ltd.

Example 10

The procedure for preparation of the photoconductor in Example 1 was repeated to obtain a photoconductor of the present invention except that the formulation of the charge generating layer coating liquid was as follows:

| Formulation of charge generating layer coating liquid | |
|---|---|
| Y-type titanyl phthalocyanine | 5 |
| Polyvinyl butyral resin (S-lec BM-S, manufactured by Sekisui Chemical Co., Ltd.) | 5 |
| Tetrahydrofuran | 300 |

Comparative Example 1

The procedure for preparation of the photoconductor in Example 1 was repeated to obtain a comparative photoconductor except that the formulation of the charge transporting layer coating liquid was as follows:

| Formulation of charge transporting layer coating liquid | |
|---|---|
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Comparative Example 2

The procedure for preparation of the photoconductor in Example 1 was repeated to obtain a comparative photoconductor except that the formulation of the charge transporting layer coating liquid was as follows:

| Formulation of charge transporting layer coating liquid | |
|---|---|
| Dimethyl polysiloxane (KF96, manufactured by Shin-Etsu Silicone Co., Ltd. whose viscosity was 300 cSt) | 0.5 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Comparative Example 3

The procedure for preparation of the photoconductor in Example 1 was repeated to obtain a comparative photoconductor except that the formulation of the charge transporting layer coating liquid was as follows:

| Formulation of charge transporting layer coating liquid | |
|---|---|
| Methacryl modified polysiloxane (X-22-164B, manufactured by Shin-Etsu Silicone Co., Ltd. whose viscosity was 54 cSt) | 0.5 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Comparative Example 4

The procedure for preparation of the photoconductor in Example 1 was repeated to obtain a comparative photoconductor except that the formulation of the charge transporting layer coating liquid was as follows:

| Formulation of charge transporting layer coating liquid | |
|---|---|
| Silicone grafted polymer (GS-30, manufactured by Toa Gosei Chemical Industry Co., Ltd.) | 0.5 |
| 4-diethylaminobenzyldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Comparative Example 5

The procedure for preparation of the photoconductor in Example 1 was repeated to obtain a comparative photoconductor except that the formulation of the charge transporting layer coating liquid was as follows:

| Formulation of charge transporting layer coating liquid | |
|---|---|
| Epoxy modified polysiloxane (X-22-163C, manufactured by Shin-Etsu Silicone Co., Ltd. whose viscosity was 103 cSt) | 0.20 |

-continued

| Formulation of charge transporting layer coating liquid | |
|---|---|
| Carbinol modified polysiloxane (KF6001, manufactured by Shin-Etsu Silicone Co., Ltd whose viscosity was 42 cSt) | 0.30 |
| 4-diethylaminobenzyldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Comparative Example 6

The procedure for preparation of the photoconductor in Example 1 was repeated to obtain a comparative photoconductor except that the formulation of the charge transporting layer coating liquid was as follows:

| Formulation of charge transporting layer coating liquid | |
|---|---|
| Dimethyl polysiloxane (SH200, manufactured by Dow Corning-Toray Silicone Co., Ltd. whose viscosity was 100 cSt) | 0.25 |
| Methylhydrodiene polysiloxane (KF99, manufactured by Shin-Etsu Silicone Co., Ltd. whose viscosity was 20 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

The thus obtained photoconductors were evaluated by the following methods using the apparatus which was disclosed in Japanese Laid-Open Patent Publication No. 60-100167.

(1) Surface potential retaining rate (Vo/Vm) Surface potential retaining rate (Vo/Vm) of a photoconductor was defined as a ratio of a surface potential (Vo) to a maximum surface potential (Vm).

1) Maximum surface potential (Vm)

The maximum surface potential (Vm) was defined as a surface potential of a photoconductor 20 seconds after the photoconductor started to be charged under a condition of −6 kV (unit: V).

2) Surface potential (Vo)

The surface potential (Vo) was defined as a surface potential of a photoconductor when the photoconductor was kept in a dark place for 20 seconds after the charging was stopped (unit: V).

(2) Residual surface potential (VR)

Residual surface potential (VR) was defined as a residual surface potential of a photoconductor when monochrome light which had an intensity of 1 $\mu W/cm^2$ and a wave length of 780 nm whose half-width was 20 nm was irradiated to a photoconductor having a surface potential of Vo for 20 seconds.

(3) Exposure (E1/2)

Exposure (E1/2) was defined as light exposure amount required when the surface potential of a photoconductor is decayed from Vo to Vo/2 (unit: $\mu J/cm^2$).

(4) continuous copying test

Each photoconductor was installed in a modified DA-355 copying machine which was manufactured by Ricoh Co., Ltd. and ten thousand images were continuously reproduced.

The recorded images were evaluated whether there was an undesirable image. Each photoconductor was also evaluated in respect of the above-mentioned items of from (1) to (3) after the continuous copying test.

The results are shown in Table 1.

TABLE 1

| | Initial values | | | Values after continuous test | | | Occurrence of undesired image in recorded images |
|---|---|---|---|---|---|---|---|
| | Vo/Vm | E½ | VR | Vo/Vm | E½ | VR | |
| Example 1 | 0.724 | 1.17 | 21 | 0.684 | 1.24 | 32 | none |
| Example 2 | 0.721 | 1.08 | 19 | 0.660 | 1.11 | 28 | fine line (8,000~)* |
| Example 3 | 0.722 | 1.14 | 19 | 0.664 | 1.19 | 28 | none |
| Example 4 | 0.724 | 1.24 | 22 | 0.685 | 1.25 | 34 | none |
| Example 5 | 0.730 | 1.27 | 23 | 0.699 | 1.27 | 35 | none |
| Example 6 | 0.724 | 1.15 | 20 | 0.681 | 1.33 | 31 | fine line (8,000~)* |
| Example 7 | 0.723 | 1.21 | 21 | 0.666 | 1.22 | 31 | none |
| Example 8 | 0.742 | 1.28 | 24 | 0.687 | 1.27 | 37 | none |
| Example 9 | 0.722 | 1.17 | 20 | 0.666 | 1.23 | 30 | none |
| Example 10 | 0.714 | 0.98 | 30 | 0.661 | 1.00 | 32 | none |
| Comparative Example 1 | 0.718 | 1.07 | 18 | 0.711 | 1.10 | 28 | fine line (1~)*2 |
| Comparative Example 2 | 0.710 | 1.07 | 20 | 0.670 | 1.02 | 30 | fine line (4,000~)*3 |
| Comparative Example 3 | 0.776 | 1.27 | 26 | 0.729 | 1.32 | 42 | fine line (1,000~)*4 |
| Comparative Example 4 | 0.705 | 1.15 | 35 | 0.620 | 1.25 | 82 | fouling was occurred |
| Comparative Example 5 | 0.720 | 1.05 | 35 | 0.670 | 1.10 | 38 | fine line (5,000~)*5 |
| Comparative Example 6 | 0.718 | 1.02 | 38 | 0.673 | 1.12 | 78 | fouling was occurred |

Notes:
fine line (8,000~)*
This means that fine lines of the images were not reproduced from the 8,000th recorded image.
fine line (1~)*2
This means that fine lines of the images were not reproduced from the first recorded image.
fine line (4,000~)*3
This means that fine lines of the images were not reproduced from the 4,000th recorded image.
fine line (4,000~)*4
This means that fine lines of the images were not reproduced from the 1,000th recorded image.
fine line (5,000~)*5
This means that fine lines of the images were not reproduced from the 5,000th recorded image.

Example 11

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Dimethyl polysiloxane (KF96, manufactured by Shin-Etsu Silicone Co., Ltd. whose viscosity was 300 cSt) | 0.25 |
| Alkyl modified polysiloxane (BY16-846, manufactured by Dow Corning-Toray Silicone Co., Ltd. whose viscosity was 20 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 12

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Dimethyl polysiloxane (KF96, manufactured by Shin-Etsu Silicone Co., Ltd. whose viscosity was 300 cSt) | 0.01 |
| Alkyl modified polysiloxane (BY16-846, manufactured by Dow Corning-Toray Silicone Co., Ltd. whose viscosity was 20 cSt) | 0.01 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 13

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Dimethyl polysiloxane (KF96, manufactured by Shin-Etsu Silicone Co., Ltd. whose viscosity was 300 cSt) | 0.025 |
| Alkyl modified polysiloxane (BY16-846, manufactured by Dow Corning-Toray Silicone Co., Ltd. whose viscosity was 20 cSt) | 0.025 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 14

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Dimethyl Polysiloxane (KF96, manufactured by Shin-Etsu Silicone Co., Ltd. whose viscosity was 300 cSt) | 0.5 |
| Alkyl modified polysiloxane (BY16-846, manufactured by Dow Corning-Toray Silicone Co., Ltd. whose viscosity was 20 cSt) | 0.5 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 15

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Dimethyl polysiloxane (KF96, manufactured by Shin-Btsu Silicone Co., Ltd. whose viscosity was 300 cSt) | 0.75 |
| Alkyl modified polysiloxane (BY16-846, manufactured by Dow Corning-Toray Silicone Co., Ltd. whose viscosity was 20 cSt) | 0.75 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 16

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Dimethyl polysiloxane (KF96, manufactured by Shin-Etsu Silicone Co., Ltd. whose viscosity was 50 cSt) | 0.25 |
| Alkyl modified polysiloxane (BY16-846, manufactured by Dow Corning-Toray Silicone Co., Ltd. whose viscosity was 20 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 17

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Dimethyl polysiloxane (KF96, manufactured by Shin-Etsu Silicone Co., Ltd. whose viscosity was 50 cSt) | 0.25 |
| Alkyl modified polysiloxane (KF410, manufactured by Shin-Etsu Silicone Co., Ltd. whose viscosity was 1,000 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 18

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Dimethyl polysiloxane (KF96, manufactured by Shin-Etsu Silicone Co., Ltd. whose viscosity was 100 cSt) | 0.25 |
| Alkyl modified polysiloxane (KF413, manufactured by Shin-Etsu Silicone Co., Ltd. whose viscosity was 100 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 19

The procedure for preparation of the photoconductor in Example 1 was repeated to obtain a photoconductor of the present invention except that the polycarbonate resin in the charge transporting layer coating liquid was replaced with 10 parts of a polycarbonate resin. Panlite K-1300, which was manufactured by Teijin Chemicals Ltd.

Example 20

The procedure for preparation of the photoconductor in Example 11 was repeated to obtain a photoconductor of the present invention except that the formulation of the charge generating layer coating liquid was as follows:

| Formulation of charge generating layer coating liquid | |
|---|---|
| Y-type titanyl phthalocyanine | 5 |
| Polyvinyl butyral resin (S-lec BM-S, manufactured by Sekisui Chemical Co., Ltd.) | 5 |
| Tetrahydrofuran | 300 |

Comparative Example 7

The procedure for preparation of the photoconductor in Example 11 was repeated to obtain a comparative photoconductor except that the formulation of the charge transporting layer coating liquid was as follows:

| Formulation of charge transporting layer coating liquid | |
|---|---|
| Alkyl modified polysiloxane (BY16-846, manufactured by Dow Corning-Toray Silicone Co., Ltd. whose viscosity was 20 cSt) | 0.5 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Each photoconductor was evaluated in the same wav as mentioned above. The results are shown in Table 2.

TABLE 2

| | Initial values | | | Values after continuous test | | | Occurrence of undesired image in recorded images |
|---|---|---|---|---|---|---|---|
| | Vo/Vm | E½ | VR | Vo/Vm | E½ | VR | |
| Example 11 | 0.721 | 1.23 | 24 | 0.677 | 1.32 | 32 | none |
| Example 12 | 0.718 | 1.12 | 20 | 0.653 | 1.18 | 29 | fine line (8,000~) |
| Example 13 | 0.718 | 1.14 | 20 | 0.666 | 1.25 | 30 | none |
| Example 14 | 0.723 | 1.25 | 25 | 0.677 | 1.39 | 34 | none |
| Example 15 | 0.723 | 1.30 | 26 | 0.684 | 1.41 | 34 | none |
| Example 16 | 0.728 | 1.17 | 24 | 0.675 | 1.30 | 30 | fine line (7,000~)* |
| Example 17 | 0.730 | 1.23 | 22 | 0.683 | 1.34 | 33 | none |
| Example 18 | 0.733 | 1.31 | 26 | 0.685 | 1.44 | 34 | none |
| Example 19 | 0.730 | 1.15 | 22 | 0.682 | 1.27 | 34 | |
| Example 20 | 0.712 | 1.01 | 32 | 0.666 | 1.03 | 34 | none |
| Comparative Example 1 | 0.718 | 1.07 | 18 | 0.711 | 1.10 | 28 | fine line (1~) |
| Comparative Example 2 | 0.710 | 1.07 | 20 | 0.670 | 1.02 | 30 | fine line (4,000~) |
| Comparative Example 4 | 0.705 | 1.15 | 35 | 0.620 | 1.25 | 82 | fouling was occurred |
| Comparative Example 7 | 0.803 | 1.39 | 24 | 0.762 | 1.46 | 44 | fine line (1,000~) |

Notes:
fine line (7,000~)*
This means that fine lines of the images were not reproduced from the 7,000th recorded image.

Example 21

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Dimethyl polysiloxane (KF96, manufactured by Shin-Etsu Silicone Co., Ltd. whose viscosity was 300 cSt) | 0.25 |
| Vinyl modified polysiloxane (FM2231, manufactured by Chisso Co., Ltd. whose viscosity was 1,000 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 22

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Dimethyl polysiloxane (KF96, manufactured by Shin-Etsu Silicone Co., Ltd. whose viscosity was 300 cSt) | 0.01 |
| Vinyl modified polysiloxane (FM2231, manufactured by Chisso Co., Ltd. whose viscosity was 1,000 cSt) | 0.01 |

-continued

| Formulation of charge transporting layer coating liquid | |
|---|---|
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 23

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Dimethyl polysiloxane (KF96, manufactured by Shin-Etsu Silicone Co., Ltd. whose viscosity was 300 cSt) | 0.025 |
| Vinyl modified polysiloxane (FM2231, manufactured by Chisso Co., Ltd. whose viscosity was 1,000 cSt) | 0.025 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 24

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Dimethyl polysiloxane (KF96, manufactured by Shin-Etsu Silicone Co., Ltd. whose viscosity was 300 cSt) | 0.5 |
| Vinyl modified polysiloxane (FM2231, manufactured by Chisso Co., Ltd. whose viscosity was 1,000 cSt) | 0.5 |
| 4-diethylaminobenzaldehyde-1-benzyl-1-phenylhydrazone | 7 |
| polycarbonate resin (Iupilon Z-200, manufactured by Mitsubishi Gas Chemical Co., Ltd.) | 10 |
| Methylene chloride | 75 |

Example 25

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Dimethyl polysiloxane (KF96, manufactured by Shin-Etsu Silicone Co., Ltd. whose viscosity was 300 cSt) | 0.75 |
| Vinyl modified polysiloxane (FM2231, manufactured by Chisso Co., Ltd. whose viscosity was 1,000 cSt) | 0.75 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 26

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Dimethyl polysiloxane (KF96, manufactured by Shin-Etsu Silicone Co., Ltd. whose viscosity was 50 cSt) | 0.25 |
| Vinyl modified polysiloxane (FM2231, manufactured by Chisso Co., Ltd. whose viscosity was 1,000 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 27

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Dimethyl polysiloxane (KF96, manufactured by Shin-Etsu Silicone Co., Ltd. whose viscosity was 50 cSt) | 0.25 |
| Vinyl modified polysiloxane (FM2242, manufactured by Chisso Co., Ltd. whose viscosity was 20,000 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 28

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Dimethyl polysiloxane (KF96, manufactured by Shin-Etsu Silicone Co., Ltd. whose viscosity was 100 cSt) | 0.25 |
| Vinyl modified polysiloxane (FP2241, manufactured by Chisso Co., Ltd. whose viscosity was 10,000 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 29

The procedure for preparation of the photoconductor in Example 21 was repeated to obtain a photoconductor of the present invention except that the polycarbonate resin in the charge transporting layer coating liquid was replaced with 10 parts of a polycarbonate resin Panlite K-1300, which was manufactured by Teijin Chemicals Ltd.

Example 30

The procedure for preparation of the photoconductor in Example 21 was repeated to obtain a photoconductor of the present invention except that the formulation of the charge generating layer coating liquid was as follows:

| Formulation of charge generating layer coating liquid | |
|---|---|
| Y-type titanyl phthalocyanine | 5 |
| Polyvinyl butyral resin (S-lec BM-S, manufactured by Sekisui Chemical Co., Ltd.) | 5 |
| Tetrahydrofuran | 300 |

Comparative Example 8

The procedure for preparation of the photoconductor in Example 21 was repeated to obtain a comparative photoconductor except that the formulation of the charge transporting layer coating liquid was as follows:

| Formulation of charge transporting layer coating liquid | |
|---|---|
| Vinyl modified polysiloxane (MF2231, manufactured by Chisso Co., Ltd. whose viscosity was 1,000 cSt) | 0.5 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Each photoconductor was evaluated in the same way as mentioned above. The results are shown in Table 3.

TABLE 3

| | Initial values | | | Values after continuous test | | | Occurrence of undesired image in recorded images |
|---|---|---|---|---|---|---|---|
| | Vo/Vm | E½ | VR | Vo/Vm | E½ | VR | |
| Example 21 | 0.729 | 1.18 | 21 | 0.687 | 1.32 | 33 | none |
| Example 22 | 0.724 | 1.11 | 18 | 0.662 | 1.19 | 29 | fine line (8,000~) |
| Example 23 | 0.725 | 1.15 | 20 | 0.662 | 1.27 | 30 | none |
| Example 24 | 0.730 | 1.21 | 22 | 0.699 | 1.33 | 33 | none |
| Example 25 | 0.730 | 1.26 | 23 | 0.702 | 1.34 | 35 | none |
| Example 26 | 0.729 | 1.23 | 21 | 0.690 | 1.47 | 32 | fine line (8,000~) |
| Example 27 | 0.739 | 1.17 | 22 | 0.695 | 1.29 | 31 | none |
| Example 28 | 0.742 | 1.26 | 25 | 0.691 | 1.39 | 34 | none |
| Example 29 | 0.733 | 1.19 | 21 | 0.677 | 1.29 | 32 | none |
| Example 30 | 0.716 | 0.99 | 28 | 0.671 | 1.00 | 32 | none |
| Comparative Example 1 | 0.718 | 1.07 | 18 | 0.711 | 1.10 | 28 | fine line (1~) |
| Comparative Example 2 | 0.710 | 1.07 | 20 | 0.670 | 1.02 | 30 | fine line (4,000~) |
| Comparative Example 4 | 0.705 | 1.15 | 35 | 0.620 | 1.25 | 82 | fouling was occurred |
| Comparative Example 8 | 0.793 | 1.36 | 23 | 0.750 | 1.46 | 43 | fine line (2,000~)* |

Notes:
fine line (2,000~)*
This means that fine lines of the images were not reproduced from the 2,000th recorded image.

Example 31

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methylphenyl polysiloxane (KF50, manufactured by Shin-Etsu Silicone Co., Ltd. whose viscosity was 500 cSt) | 0.25 |
| Methacryl modified polysiloxane (X-22-164B, manufactured by Shin-Etsu Silicone Co., Ltd. whose viscosity was 54 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 32

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methylphenyl polysiloxane (KF50, manufactured by Shin-Etsu Silicone Co., Ltd. whose viscosity was 500 cSt) | 0.01 |
| Methacryl modified polysiloxane (X-22-164B, manufactured by Shin-Etsu Silicone Co., Ltd. whose viscosity was 54 cSt) | 0.01 |

-continued

| Formulation of charge transporting layer coating liquid | |
|---|---|
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 33

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methylphenyl polysiloxane (KF50, manufactured by Shin-Etsu Silicone Co., Ltd. whose viscosity was 500 cSt) | 0.025 |
| Methacryl modified polysiloxane (X-22-164B, manufactured by Shin-Etsu Silicone Co., Ltd. whose viscosity was 54 cSt) | 0.025 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 34

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methylphenyl polysiloxane (KF50, manufactured by Shin-Etsu Silicone Co., Ltd. whose viscosity was 500 cSt) | 0.5 |
| Methacryl modified polysiloxane (X-22-164B, manufactured by Shin-Etsu Silicone Co., Ltd. whose viscosity was 54 cSt) | 0.5 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 35

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methylphenyl polysiloxane (KF50, manufactured by Shin-Etsu Silicone Co., Ltd. whose viscosity was 500 cSt) | 0.75 |
| Methacryl modified polysiloxane (X-22-164B, manufactured by Shin-Etsu Silicone Co., Ltd. whose viscosity was 54 cSt) | 0.75 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 36

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methylphenyl polysiloxane (SH702, manufactured by Dow Corning-Toray Silicone Co., Ltd. whose viscosity was 45 cSt) | 0.25 |
| Methacryl modified polysiloxane (X-22-164B, manufactured by Shin-Etsu Silicone Co., Ltd. whose viscosity was 54 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 37

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methylphenyl polysiloxane (SH702, manufactured by Dow Corning-Toray Silicone Co., Ltd. whose viscosity was 45 cSt) | 0.25 |
| Methacryl modified polysiloxane (FM0725, manufactured by Chisso Co., Ltd. whose viscosity was 200 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 38

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methylphenyl polysiloxane (KF50, manufactured by Shin-Etsu Silicone Co., Ltd. whose viscosity was 100 cSt) | 0.25 |
| Methacryl modified polysiloxane (X-22-164C, manufactured by Shin-Etsu Silicone Co., Ltd. whose viscosity was 94 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 39

The procedure for preparation of the photoconductor in Example 31 was repeated to obtain a photoconductor of the present invention except that the polycarbonate resin in the charge transporting layer coating liquid was replaced with 10 parts of a polycarbonate resin. Panlite K-1300, which was manufactured by Teijin Chemicals Ltd.

Example 40

The procedure for preparation of the photoconductor in Example 31 was repeated to obtain a photoconductor of the present invention except that the formulation of the charge generating layer coating liquid was as follows:

| Formulation of charge generating layer coating liquid | |
|---|---|
| Y-type titanyl phthalocyanine | 5 |
| Polyvinyl butyral resin (S-lec BM-S, manufactured by Sekisui Chemical Co., Ltd.) | 5 |
| Tetrahydrofuran | 300 |

Each photoconductor was evaluated in the same way as mentioned above. The results are shown in Table 4.

TABLE 4

| | Initial values | | | Values after continuous test | | | Occurrence of undesired image in recorded images |
|---|---|---|---|---|---|---|---|
| | Vo/Vm | E½ | VR | Vo/Vm | E½ | VR | |
| Example 31 | 0.737 | 1.28 | 22 | 0.698 | 1.31 | 33 | none |
| Example 32 | 0.721 | 1.14 | 19 | 0.669 | 1.15 | 30 | fine line (7,000~) |
| Example 33 | 0.729 | 1.20 | 19 | 0.669 | 1.23 | 31 | none |
| Example 34 | 0.740 | 1.31 | 23 | 0.701 | 1.33 | 34 | none |
| Example 35 | 0.743 | 1.33 | 24 | 0.701 | 1.36 | 34 | none |
| Example 36 | 0.740 | 1.35 | 22 | 0.698 | 1.29 | 35 | fine line (8,000~) |
| Example 37 | 0.735 | 1.27 | 20 | 0.688 | 1.25 | 33 | none |
| Example 38 | 0.758 | 1.37 | 25 | 0.715 | 1.39 | 37 | none |
| Example 39 | 0.740 | 1.29 | 22 | 0.685 | 1.31 | 34 | none |
| Example 40 | 0.720 | 1.02 | 29 | 0.664 | 1.06 | 34 | none |
| Comparative Example 1 | 0.718 | 1.07 | 18 | 0.711 | 1.10 | 28 | fine line (1~) |
| Comparative Example 2 | 0.710 | 1.07 | 20 | 0.670 | 1.02 | 30 | fine line (4,000~) |
| Comparative Example 4 | 0.705 | 1.15 | 35 | 0.620 | 1.25 | 82 | fouling was occurred |

Example 41

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methylphenyl polysiloxane (KF50, manufactured by Shin-Etsu Silicone Co., Ltd. whose viscosity was 500 cSt) | 0.25 |
| Alkyl modified polysiloxane (BY16-846, manufactured by Dow Corning-Toray Silicone Co., Ltd. whose viscosity was 20 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 42

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methylphenyl polysiloxane (KF50, manufactured by Shin-Etsu Silicone Co., Ltd. whose viscosity was 500 cSt) | 0.01 |
| Alkyl modified polysiloxane (BY16-846, manufactured by Dow Corning-Toray Silicone Co., Ltd. whose viscosity was 20 cSt) | 0.01 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 43

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methylphenyl polysiloxane (KF50, manufactured by Shin-Etsu Silicone Co., Ltd. whose viscosity was 500 cSt) | 0.025 |
| Alkyl modified polysiloxane (BY16-846, manufactured by Dow Corning-Toray Silicone Co., Ltd. whose viscosity was 20 cSt) | 0.025 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 44

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methylphenyl polysiloxane (KF50, manufactured by Shin-Etsu Silicone Co., Ltd. whose viscosity was 500 cSt) | 0.5 |
| Alkyl modified polysiloxane (BY16-846, manufactured by Dow Corning-Toray Silicone Co., Ltd. whose viscosity was 20 cSt) | 0.5 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 45

The procedure for preparation of the photoconductor in Example 1 vas repeated to obtain a photoconductor of the present invention except that the formulation of the charge transporting layer coating liquid was as follows:

| Formulation of charge transporting layer coating liquid | |
|---|---|
| Methylphenyl polysiloxane (KF50, manufactured by Shin-Etsu Silicone Co., Ltd. whose viscosity was 500 cSt) | 0.75 |
| Alkyl modified polysiloxane (BY16-846, manufactured by Dow Corning-Toray Silicone Co., Ltd. whose viscosity was 20 cSt) | 0.75 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 46

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methylphenyl polysiloxane (SH702, manufactured by Dow Corning-Toray Silicone Co., Ltd. whose viscosity was 45 cSt) | 0.25 |
| AIkyl modified polysiloxane (BY16-846, manufactured by Dow Corning-Toray Silicone Co., Ltd. whose viscosity was 20 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 47

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methylphenyl polysiloxane (SH702, manufactured by Dow Corning-Toray Silicone Co., Ltd. whose viscosity was 45 cSt) | 0.25 |
| Alkyl modified polysiloxane (KF410, manufactured by Shin-Etsu Silicone Co., Ltd. whose viscosity was 1,000 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 48

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methylphenyl polysiloxane (KF50, manufactured by Shin-Etsu Silicone Co., Ltd. whose viscosity was 100 cSt) | 0.25 |
| Alkyl modified polysiloxane (KF413, manufactured by Shin-Etsu Silicone Co., Ltd. whose viscosity was 100 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 49

The procedure for preparation of the photoconductor in Example 41 was repeated to obtain a photoconductor of the present invention except that the polycarbonate resin in the charge transporting layer coating liquid was replaced with 10 parts of a polycarbonate resin. Panlite K-1300, which was manufactured by Teijin Chemicals ltd.

Example 50

The procedure for preparation of the photoconductor in Example 41 was repeated to obtain a photoconductor of the present invention except that the formulation of the charge generating layer coating liquid was as follows:

| Formulation of charge generating layer coating liquid | |
|---|---|
| Y-type titanyl phthalocyanine | 5 |
| Polyvinyl butyral resin (S-Iec BM-S, manufactured by Sekisui Chemical Co., Ltd.) | 5 |
| Tetrahydrofuran | 300 |

Each photoconductor was evaluated in the same way as mentioned above. The results are shown in Table 5.

TABLE 5

| | Initial values | | | Values after continuous test | | | Occurrence of undesired image in recorded images |
|---|---|---|---|---|---|---|---|
| | Vo/Vm | E½ | VR | Vo/Vm | E½ | VR | |
| Example 41 | 0.721 | 1.23 | 24 | 0.677 | 1.32 | 32 | none |
| Example 42 | 0.718 | 1.12 | 20 | 0.653 | 1.18 | 29 | fine line (8,000~) |
| Example 43 | 0.718 | 1.14 | 20 | 0.666 | 1.25 | 30 | none |
| Example 44 | 0.723 | 1.25 | 25 | 0.677 | 1.39 | 34 | none |
| Example 45 | 0.723 | 1.30 | 26 | 0.684 | 1.41 | 34 | none |
| Example 46 | 0.728 | 1.17 | 24 | 0.675 | 1.30 | 30 | fine line (7,000~) |
| Example 47 | 0.730 | 1.23 | 22 | 0.683 | 1.34 | 33 | none |
| Example 48 | 0.733 | 1.31 | 26 | 0.685 | 1.44 | 34 | none |
| Example 49 | 0.730 | 1.15 | 22 | 0.682 | 1.27 | 34 | none |
| Example 50 | 0.712 | 1.00 | 30 | 0.674 | 1.04 | 32 | none |
| Comparative Example 1 | 0.718 | 1.07 | 18 | 0.711 | 1.10 | 28 | fine line (1~) |
| Comparative Example 2 | 0.710 | 1.07 | 20 | 0.670 | 1.02 | 30 | fine line (4,000~) |
| Comparative Example 4 | 0.705 | 1.15 | 35 | 0.620 | 1.25 | 82 | fouling was occurred |

Example 51

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methylphenyl polysiloxane (KF50, manufactured by Shin-Etsu Silicone Co., Ltd. whose viscosity was 500 cSt) | 0.25 |
| Vinyl modified polysiloxane (FM2231, manufactured by Chisso Co., Ltd. whose viscosity was 1,000 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 52

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methylphenyl polysiloxane (KF50, manufactured by Shin-Etsu Silicone Co., Ltd. whose viscosity was 500 cSt) | 0.01 |
| Vinyl modified polysiloxane (FM2231, manufactured by Chisso Co., Ltd. whose viscosity was 1,000 cSt) | 0.01 |
| 4-diethylaminobenzaldehyde-1-benzyl-1 phenylhydrazone | 7 |
| Polycarbonate resin (Iupilon Z-200, manufactured by Mitsubishi Gas Chemical Co., Ltd.) | 10 |
| Methylene chloride | 75 |

Example 53

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methylphenyl polysiloxane (KF50, manufactured by Shin-Etsu Silicone Co., Ltd. whose viscosity was 500 cSt) | 0.025 |
| Vinyl modified polysiloxane (FM2231, manufactured by Chisso Co., Ltd. whose viscosity was 1,000 cSt) | 0.025 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 54

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methylphenyl polysiloxane (KF50, manufactured by Shin-Etsu Silicone Co., Ltd. whose viscosity was 500 cSt) | 0.5 |
| Vinyl modified polysiloxane (FM2231, manufactured by Chisso Co., Ltd. whose viscosity was 1,000 cSt) | 0.5 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 55

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methylphenyl polysiloxane (KF50, manufactured by Shin-Etsu Silicone Co., Ltd. whose viscosity was 500 cSt) | 0.75 |
| Vinyl modified polysiloxane (FM2231, manufactured by Chisso Co., Ltd. whose viscosity was 1,000 cSt) | 0.75 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 56

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methylphenyl polysiloxane (SH702, manufactured by Dow-Corning-Toray Silicone Co., Ltd. whose viscosity was 45 cSt) | 0.25 |
| Vinyl modified polysiloxane (FM2231, manufactured by Chisso Co., Ltd. whose viscosity was 1,000 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 57

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methylphenyl polysiloxane (SH702, manufactured by Dow-Corning-Toray Silicone Co., Ltd. whose viscosity was 45 cSt) | 0.25 |
| Vinyl modified polysiloxane (FM2242, manufactured by Chisso Co., Ltd. whose viscosity was 20,000 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 58

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methylphenyl polysiloxane (KF50, manufactured by Shin-Etsu Silicone Co., Ltd. whose viscosity was 100 cSt) | 0.25 |
| Vinyl modified polysiloxane (FP2241, manufactured by Chisso Co., Ltd whose viscosity was 10,000 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 59

The procedure for preparation of the photoconductor in Example 51 was repeated to obtain a photoconductor of the present invention except that the polycarbonate resin in the charge transporting layer coating liquid was replaced with 10 parts of a polycarbonate resin. Panlite K-1300, which was manufactured by Teijin Chemicals Ltd.

Example 60

The procedure for preparation of the photoconductor in Example 51 was repeated to obtain a photoconductor of the present invention except that the formulation of the charge generating layer coating liquid was as follows:

| Formulation of charge generating layer coating liquid | |
|---|---|
| Y-type titanyl phthalocyanine | 5 |
| Polyvinyl butyral resin (S-lec BM-S, manufactured by Sekisui Chemical Co., Ltd.) | 5 |
| Tetrahydrofuran | 300 |

Each photoconductor was evaluated in the same way as mentioned above. The results are shown in Table 6.

TABLE 6

| | Initial values | | | Values after continuous test | | | Occurrence of |
|---|---|---|---|---|---|---|---|
| | Vo/Vm | E1/2 | VR | Vo/Vm | E1/2 | VR | undesired image in recorded images |
| Example 51 | 0.729 | 1.18 | 21 | 0.687 | 1.32 | 33 | none |
| Example 52 | 0.724 | 1.11 | 18 | 0.662 | 1.19 | 29 | fine line (8,000~) |
| Example 53 | 0.725 | 1.15 | 20 | 0.662 | 1.27 | 30 | none |
| Example 54 | 0.730 | 1.21 | 22 | 0.699 | 1.33 | 33 | none |
| Example 55 | 0.730 | 1.26 | 23 | 0.702 | 1.34 | 35 | none |
| Example 56 | 0.729 | 1.23 | 21 | 0.690 | 1.47 | 32 | fine line (8,000~) |
| Example 57 | 0.739 | 1.17 | 22 | 0.695 | 1.29 | 31 | none |
| Example 58 | 0.742 | 1.26 | 25 | 0.691 | 1.39 | 34 | none |
| Example 59 | 0.733 | 1.19 | 21 | 0.677 | 1.29 | 32 | none |
| Example 60 | 0.713 | 0.98 | 28 | 0.676 | 1.02 | 33 | none |
| Comparative Example 1 | 0.718 | 1.07 | 18 | 0.711 | 1.10 | 28 | fine line (1~) |
| Comparative Example 2 | 0.710 | 1.07 | 20 | 0.670 | 1.02 | 30 | fine line (4,000~) |
| Comparative Example 4 | 0.705 | 1.15 | 35 | 0.620 | 1.25 | 82 | fouling was occurred |

Example 61

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methacryl modified polysiloxane (FM0725, manufactured by Chisso Co., Ltd. whose viscosity was 200 cSt) | 0.25 |
| Alkyl modified polysiloxane (BY16-846, manufactured by Dow Corning-Toray Silicone Co., Ltd. whose viscosity was 20 cSt) | 0.25 |

-continued

| Formulation of charge transporting layer coating liquid | |
|---|---|
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 62

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methacryl modified polysiloxane (FM0725, manufactured by Chisso Co., Ltd. whose viscosity was 200 cSt) | 0.01 |
| Alkyl modified polysiloxane (BY16-846, manufactured by Dow Corning-Toray Silicone Co., Ltd. whose viscosity was 20 cSt) | 0.01 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 63

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methacryl modified polysiloxane (FM0725, manufactured by Chisso Co., Ltd. whose viscosity was 200 cSt) | 0.025 |
| Alkyl modified polysiloxane (BY16-846, manufactured by Dow Corning-Toray Silicone Co., Ltd. whose viscosity was 20 cSt) | 0.025 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 64

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methacryl modified polysiloxane (FM0725, manufactured by Chisso Co., Ltd. whose viscosity was 200 cSt) | 0.5 |
| Alkyl modified polysiloxane (BY16-846, manufactured by Dow Corning-Toray Silicone Co., Ltd. whose viscosity was 20 cSt) | 0.5 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 65

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methacryl modified polysiloxane (FM0725, manufactured by Chisso Co., Ltd. whose viscosity was 200 cSt) | 0.75 |
| Alkyl modified polysiloxane (BY16-846, manufactured by Dow Corning-Toray Silicone Co., Ltd. whose viscosity was 20 cSt) | 0.75 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 66

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methacryl modified polysiloxane (X-22-164B, manufactured by Shin-Etsu Silicone Co., Ltd. whose viscosity was 54 cSt) | 0.25 |
| Alkyl modified polysiloxane (BY16-846, manufactured by Dow Corning-Toray Silicone Co., Ltd. whose viscosity was 20 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 67

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methacryl modified polysiloxane (X-22-164B, manufactured by Shin-Etsu Silicone Co., Ltd. whose viscosity was 54 cSt) | 0.25 |
| Alkyl modified polysiloxane (KF410, manufactured by Shin-Etsu Silicone Co., Ltd. whose viscosity was 1,000 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 68

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methacryl modified polysiloxane (X-22-164C, manufactured by Shin-Etsu Silicone Co., Ltd. whose viscosity was 94 cSt) | 0.25 |
| AIkyl modified polysiloxane (KF413, manufactured by Shin-Etsu Silicone Co., Ltd. whose viscosity was 100 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 69

The procedure for preparation of the photoconductor in Example 61 was repeated to obtain a photoconductor of the present invention except that the polycarbonate resin in the charge transporting layer coating liquid was replaced with 10 parts of a polycarbonate resin, Panlite K-1300, which was manufactured by Teijin Chemicals Ltd.

Example 70

The procedure for preparation of the photoconductor in Example 61 was repeated to obtain a photoconductor of the present invention except that the formulation of the charge generating layer coating liquid was as follows:

| Formulation of charge generating layer coating liquid | |
|---|---|
| Y-type titanyl phthalocyanine | 5 |
| Polyvinyl butyral resin (S-lec BM-S, manufactured by Sekisui Chemical Co., Ltd.) | 5 |
| Tetrahydrofuran | 300 |

Each photoconductor was evaluated in the same way as mentioned above. The results are shown in Table 7.

TABLE 7

| | Initial values | | | Values after continuous test | | | Occurrence of |
|---|---|---|---|---|---|---|---|
| | Vo/Vm | E1/2 | VR | Vo/Vm | E1/2 | VR | undesired image in recorded images |
| Example 61 | 0.729 | 1.29 | 20 | 0.679 | 1.29 | 31 | none |
| Example 62 | 0.724 | 1.14 | 18 | 0.668 | 1.18 | 28 | fine line (8,000~) |
| Example 63 | 0.724 | 1.23 | 19 | 0.660 | 1.21 | 29 | none |
| Example 64 | 0.734 | 1.36 | 22 | 0.691 | 1.37 | 31 | none |
| Example 65 | 0.735 | 1.41 | 22 | 0.711 | 1.38 | 31 | none |
| Example 66 | 0.724 | 1.28 | 23 | 0.673 | 1.40 | 30 | fine line (7,000~) |
| Example 67 | 0.727 | 1.25 | 22 | 0.688 | 1.28 | 30 | none |
| Example 68 | 0.743 | 1.44 | 22 | 0.694 | 1.46 | 33 | none |
| Example 69 | 0.737 | 1.32 | 21 | 0.690 | 1.29 | 31 | none |
| Example 70 | 0.714 | 1.01 | 27 | 0.673 | 1.05 | 35 | none |
| Comparative Example 1 | 0.718 | 1.07 | 18 | 0.711 | 1.10 | 28 | fine line (1~) |
| Comparative Example 2 | 0.710 | 1.07 | 20 | 0.670 | 1.02 | 30 | fine line (4,000~) |
| Comparative Example 4 | 0.705 | 1.15 | 35 | 0.620 | 1.25 | 82 | fouling was occurred |

Example 71

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methacryl modified polysiloxane (FM0725, manufactured by Chisso Co., Ltd. whose viscosity was 200 cSt) | 0.25 |
| Vinyl modified polysiloxane (FM2231, manufactured by Chisso Co., Ltd. whose viscosity was 1,000 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 72

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methacryl modified polysiloxane (FM0725, manufactured by Chisso Co., Ltd. whose viscosity was 200 cSt) | 0.01 |
| Vinyl modified polysiloxane (FM2231, manufactured by Chisso Co., Ltd. whose viscosity was 1,000 cSt) | 0.01 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 73

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methacryl modified polysiloxane (FM0725, manufactured by Chisso Co., Ltd. whose viscosity was 200 cSt) | 0.025 |
| Vinyl modified polysiloxane (FM2231, manufactured by Chisso Co., Ltd. whose viscosity was 1,000 cSt) | 0.025 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 74

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methacryl modified polysiloxane (FM0725, manufactured by Chisso Co., Ltd. whose viscosity was 200 cSt) | 0.5 |
| Vinyl modified polysiloxane (FM2231, manufactured by Chisso Co., Ltd. whose viscosity was 1,000 cSt) | 0.5 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 75

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methacryl modified polysiloxane (FM0725, manufactured by Chisso Co., Ltd. whose viscosity was 200 cSt) | 0.75 |
| Vinyl modified polysiloxane (FM2231, manufactured by Chisso Co., Ltd. whose viscosity was 1,000 cSt) | 0.75 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 76

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methacryl modified polysiloxane (X-22-164B, manufactured by Shin-Etsu Silicone Co., Ltd. whose viscosity was 54 cSt) | 0.25 |
| Vinyl modified polysiloxane (FM2231, manufactured by Chisso Co., Ltd. whose viscosity was 1,000 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 77

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methacryl modified polysiloxane (X-22-164B, manufactured by Shin-Etsu Silicone Co., Ltd. whose viscosity was 54 cSt) | 0.25 |
| Vinyl modified polysiloxane (FM2242, manufactured by Chisso Co., Ltd. whose viscosity was 20,000 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 78

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Methacryl modified polysiloxane (X-22-164C, manufactured by Shin-Etsu Silicone Co., Ltd. whose viscosity was 94 cSt) | 0.25 |
| Vinyl modified polysiloxane (FP2241, manufactured by Chisso Co., Ltd. whose viscosity was 10,000 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 79

The procedure for preparation of the photoconductor in Example 71 was repeated to obtain a photoconductor of the present invention except that the polycarbonate resin in the charge transporting layer coating liquid was replaced with 10 parts of a polycarbonate resin, Panlite K-1300, which was manufactured by Teijin Chemicals Ltd.

Example 80

The procedure for preparation of the photoconductor in Example 71 was repeated to obtain a photoconductor of the present invention except that the formulation of the charge generating layer coating liquid was as follows:

| Formulation of charge generating layer coating liquid | |
|---|---|
| Y-type titanyl phthalocyanine | 5 |
| Polyvinyl butyral resin (S-lec BM-S, manufactured by Sekisui Chemical Co., Ltd.) | 5 |
| Tetrahydrofuran | 300 |

Each photoconductor was evaluated in the same way as mentioned above. The results are shown in Table 8.

TABLE 8

| | Initial values | | | Values after continuous test | | | Occurrence of |
|---|---|---|---|---|---|---|---|
| | Vo/Vm | E1/2 | VR | Vo/Vm | E1/2 | VR | undesired image in recorded images |
| Example 71 | 0.729 | 1.23 | 25 | 0.677 | 1.16 | 31 | none |
| Example 72 | 0.721 | 1.09 | 20 | 0.650 | 1.11 | 29 | fine line (8,000~) |
| Example 73 | 0.726 | 1.16 | 21 | 0.670 | 1.16 | 30 | none |
| Example 74 | 0.734 | 1.27 | 25 | 0.691 | 1.19 | 32 | none |
| Example 75 | 0.735 | 1.30 | 26 | 0.711 | 1.20 | 34 | none |
| Example 76 | 0.745 | 1.29 | 21 | 0.692 | 1.30 | 34 | fine line (7,000~) |
| Example 77 | 0.744 | 1.25 | 23 | 0.689 | 1.24 | 33 | none |
| Example 78 | 0.743 | 1.30 | 28 | 0.684 | 1.21 | 36 | none |
| Example 79 | 0.738 | 1.18 | 22 | 0.695 | 1.21 | 32 | none |
| Example 80 | 0.711 | 1.10 | 31 | 0.663 | 1.01 | 33 | none |

TABLE 8-continued

| | Initial values | | | Values after continuous test | | | Occurrence of |
|---|---|---|---|---|---|---|---|
| | Vo/Vm | E1/2 | VR | Vo/Vm | E1/2 | VR | undesired image in recorded images |
| Comparative Example 1 | 0.718 | 1.07 | 18 | 0.711 | 1.10 | 28 | fine line (1~) |
| Comparative Example 2 | 0.710 | 1.07 | 20 | 0.670 | 1.02 | 30 | fine line (4,000~) |
| Comparative Example 4 | 0.705 | 1.15 | 35 | 0.620 | 1.25 | 82 | fouling was occurred |

Example 81

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Alkyl modified polysiloxane (KF410, manufactured by Shin-Etsu Silicone Co., Ltd. whose viscosity was 1,000 cSt) | 0.25 |
| Vinyl modified polysiloxane (FM2231, manufactured by Chisso Co., Ltd. whose viscosity was 1,000 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 82

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Alkyl modified polysiloxane (KF410, manufactured by Shin-Etsu Silicone Co., Ltd. whose viscosity was 1,000 cSt) | 0.01 |
| Vinyl modified polysiloxane (FM2231, manufactured by Chisso Co., Ltd. whose viscosity was 1,000 cSt) | 0.01 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 83

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Alkyl modified polysiloxane (KF410, manufactured by Shin-Etsu Silicone Co., Ltd. whose viscosity was 1,000 cSt) | 0.025 |
| Vinyl modified polysiloxane (FM2231, manufactured by Chisso Co., Ltd. whose viscosity was 1,000 cSt) | 0.025 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 84

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Alkyl modified polysiloxane (KF410, manufactured by Shin-Etsu Silicone Co., Ltd. whose viscosity was 1,000 cSt) | 0.5 |
| Vinyl modified polysiloxane (FM2231, manufactured by Chisso Co., Ltd. whose viscosity was 1,000 cSt) | 0.5 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 85

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Alkyl modified polysiloxane (KF410, manufactured by Shin-Etsu Silicone Co., Ltd. whose viscosity was 1,000 cSt) | 0.75 |
| Vinyl modified polysiloxane (FM2231, manufactured by Chisso Co., Ltd. whose viscosity was 1,000 cSt) | 0.75 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 86

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Alkyl modified polysiloxane (BY16-846, manufactured by Dow Corning-Toray Silicone Co., Ltd. whose viscosity was 20 cSt) | 0.25 |
| Vinyl modified polysiloxane (FM2231, manufactured by Chisso Co., Ltd. whose viscosity was 1,000 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 87

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Alkyl modified polysiloxane (BY16-846, manufactured by Dow Corning-Toray Silicone Co., Ltd. whose viscosity was 20 cSt) | 0.25 |
| Vinyl modified polysiloxane (FM2242, manufactured by Chisso Co., Ltd. whose viscosity was 20,000 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 88

The procedure for preparation of the photoconductor in Example 1 was repeated to obtain a photoconductor of the present invention except that the formulation of the charge transporting layer coating liquid was as follows:

| Formulation of charge transporting layer coating liquid | |
|---|---|
| Alkyl modified polysiloxane (KF413, manufactured by Shin-Etsu Silicone Co., Ltd. whose viscosity was 100 cSt) | 0.25 |
| Vinyl modified polysiloxane (FP2241, manufactured by Chisso Co., Ltd. whose viscosity was 10,000 cSt) | 0.25 |
| 4-diethylaminobenzaldehyde-1-benzyl-1-phenylhydrazone | 7 |
| Polycarbonate resin (Iupilon Z-200, manufactured by Mitsubishi Gas Chemical Co., Ltd.) | 10 |
| Methylene chloride | 75 |

Example 89

The procedure for preparation of the photoconductor in Example 81 was repeated to obtain a photoconductor of the present invention except that the polycarbonate resin in the charge transporting layer coating liquid was replaced with 10 parts of a polycarbonate resin. Panlite K-1300, which was manufactured by Teijin Chemicals Ltd.

Example 90

The procedure for preparation of the photoconductor in Example 81 was repeated to obtain a photoconductor of the present invention except that the formulation of the charge generating layer coating liquid was as follows:

| Formulation of charge generating layer coating liquid | |
|---|---|
| Y-type titanyl phthalocyanine | 5 |
| Polyvinyl butyral resin (S-lec BM-S, manufactured by Sekisui Chemical Co., Ltd.) | 5 |
| Tetrahydrofuran | 300 |

Each photoconductor was evaluated in the same way as mentioned above. The results are shown in Table 9.

TABLE 9

| | Initial values | | | Values after continuous test | | | Occurrence of |
|---|---|---|---|---|---|---|---|
| | Vo/Vm | E1/2 | VR | Vo/Vm | E1/2 | VR | undesired image in recorded images |
| Example 81 | 0.731 | 1.22 | 24 | 0.682 | 1.25 | 31 | none |
| Example 82 | 0.720 | 1.10 | 20 | 0.659 | 1.17 | 28 | fine line (7,000~) |
| Example 83 | 0.724 | 1.13 | 21 | 0.676 | 1.22 | 30 | none |
| Example 84 | 0.733 | 1.23 | 25 | 0.700 | 1.31 | 32 | none |
| Example 85 | 0.740 | 1.26 | 26 | 0.704 | 1.34 | 34 | none |
| Example 86 | 0.740 | 1.32 | 22 | 0.700 | 1.30 | 33 | fine line (8,000~) |
| Example 87 | 0.725 | 1.16 | 23 | 0.679 | 1.29 | 33 | none |
| Example 88 | 0.735 | 1.24 | 26 | 0.687 | 1.36 | 35 | none |
| Example 89 | 0.731 | 1.16 | 21 | 0.686 | 1.29 | 30 | none |
| Example 90 | 0.718 | 1.02 | 32 | 0.661 | 1.06 | 35 | none |
| Comparative Example 1 | 0.718 | 1.07 | 18 | 0.711 | 1.10 | 28 | fine line (1~) |
| Comparative Example 2 | 0.710 | 1.07 | 20 | 0.670 | 1.02 | 30 | fine line (4,000~) |
| Comparative Example 4 | 0.705 | 1.15 | 35 | 0.620 | 1.25 | 82 | fouling was occurred |

The results shown in Tables 1 to 9 clearly indicate that the photoconductors of the present invention which include a mixture of specified polysiloxane compounds can maintain high sensitivity and good stability even when repeatedly used.

This application is based on Japanese Patent Application No. 09-077988, filed on Mar. 28, 1997, incorporated therein by reference.

Having now fully described the invention, it will be apparent to one of ordinary skill in the art that many changes and modifications can be made thereto without departing from the spirit and scope of the invention as set forth therein.

What is claimed as new and desired to be secured by Letter Patent of The United States is:

1. An electrophotographic photoconductor which comprises one or more layers which are formed overlying an electroconductive substrate and at least one of which is a photoconductive layer, wherein the photoconductor comprises in a top layer thereof a polysiloxane mixture selected from the group consisting of a polysiloxane mixture of an unmodified polysiloxane compound and a modified polysiloxane compound, a mixture of a methacryl modified polysiloxane compound and an alkyl modified polysiloxane compound, a mixture of a methacryl modified polysiloxane compound and a vinyl modified polysiloxane compound, and a mixture of an alkyl modified polysiloxane compound and a vinyl modified polysiloxane compound.

2. The electrophotographic photoconductor of claim 1, wherein the polysiloxane mixture comprises a polysiloxane mixture of a dimethyl polysiloxane compound and a methacryl modified polysiloxane compound.

3. The electrophotographic photoconductor of claim 1, wherein the polysiloxane mixture comprises a polysiloxane mixture of a dimethyl polysiloxane compound and an alkyl modified polysiloxane compound.

4. The electrophotographic photoconductor of claim 1, wherein the polysiloxane mixture comprises a polysiloxane mixture of a dimethyl polysiloxane compound and a vinyl modified polysiloxane compound.

5. The electrophotographic photoconductor of claim 1, wherein the polysiloxane mixture comprises a polysiloxane mixture of a methylphenyl polysiloxane compound and a methacryl modified polysiloxane compound.

6. The electrophotographic photoconductor of claim 1, wherein the polysiloxane mixture comprises a polysiloxane mixture of a methylphenyl polysiloxane compound and an alkyl modified polysiloxane compound.

7. The electrophotographic photoconductor of claim 1, wherein the polysiloxane mixture comprises a polysiloxane mixture of a methylphenyl polysiloxane compound and a vinyl modified polysiloxane compound.

8. The electrophotographic photoconductor of claim 1, wherein the polysiloxane mixture comprises a polysiloxane mixture of a methacryl modified polysiloxane compound and an alkyl modified polysiloxane compound.

9. The electrophotographic photoconductor of claim 1, wherein the polysiloxane mixture comprises a polysiloxane mixture of a methacryl modified polysiloxane compound and a vinyl modified polysiloxane compound.

10. The electrophotographic photoconductor of claim 1, wherein the polysiloxane mixture comprises a polysiloxane mixture of an alkyl modified polysiloxane compound and a vinyl modified polysiloxane compound.

11. The electrophotographic photoconductor of claim 1, wherein the top layer of the electrophotographic photoconductor further comprises a binder resin, and wherein the polysiloxane mixture is present in the top layer in an amount of from about 0.5 to about 10% by weight of the binder resin.

12. The electrophotographic photoconductor of claim 1, wherein at least one of the siloxane compound has viscosity greater than about 100 cSt at 25° C.

13. The electrophotographic photoconductor of claim 1, wherein the ratio of a polysiloxane compound to another polysiloxane compound in the polysiloxane mixture is from about 5/95 to about 95/5 by weight.

14. The electrophotographic photoconductor of claim 11, wherein the binder resin comprises a polycarbonate resin comprising a repeating unit having the following formula:

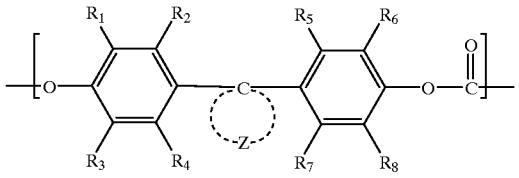

wherein Z represents nonmetal atoms which can form a carbon ring, a substituted carbon ring, a heterocyclic ring or a substituted heterocyclic ring; and R1, R2, R3, R4, R5, R6, R7 and R8 independently represent a hydrogen atom, a halogen atom, an aliphatic group, a substituted aliphatic group, a carbon ring, or a substituted carbon ring.

15. The electrophotographic photoconductor of claim 1, wherein the photoconductive layer is a functionally-separated multi-layer type photoconductive layer which comprises a charge generating layer and a charge transporting layer.

16. The electrophotographic photoconductor of claim 1, wherein the photoconductive layer is a single-layer type photoconductive layer which comprises a charge generating material and a charge transporting material.

* * * * *